US009750982B2

(12) United States Patent
Mimura et al.

(10) Patent No.: US 9,750,982 B2
(45) **Date of Patent: *Sep. 5, 2017**

(54) GOLF BALL

(71) Applicant: DUNLOP SPORTS CO. LTD., Kobe-shi, Hyogo (JP)

(72) Inventors: Kohei Mimura, Kobe (JP); Takahiro Sajima, Kobe (JP); Hironori Takihara, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 36 days.

This patent is subject to a terminal disclaimer.

(21) Appl. No.: 14/933,192

(22) Filed: Nov. 5, 2015

(65) Prior Publication Data

US 2016/0184648 A1 Jun. 30, 2016

(30) Foreign Application Priority Data

Dec. 26, 2014 (JP) ..... 2014-263836
Dec. 26, 2014 (JP) ..... 2014-264075
Dec. 26, 2014 (JP) ..... 2014-264293

(51) Int. Cl.
*A63B 37/14* (2006.01)
*A63B 37/00* (2006.01)

(52) U.S. Cl.
CPC ..... *A63B 37/0021* (2013.01); *A63B 37/002* (2013.01); *A63B 37/0006* (2013.01); *A63B 37/0017* (2013.01); *A63B 37/0018* (2013.01); *A63B 37/0019* (2013.01); *A63B 37/0029* (2013.01); *A63B 37/0047* (2013.01); *A63B 37/0075* (2013.01); *A63B 37/0076* (2013.01); *A63B 37/0077* (2013.01); *A63B 37/0092* (2013.01); *A63B 37/0012* (2013.01); *A63B 37/0031* (2013.01); *A63B 37/0033* (2013.01); *A63B 37/0043* (2013.01); *A63B 37/0045* (2013.01)

(58) Field of Classification Search
USPC ..... 473/324–350, 351–384
See application file for complete search history.

(56) References Cited

U.S. PATENT DOCUMENTS 4,142,727 A * 3/1979 Shaw ..... A63B 37/0004 473/381
6,390,938 B1 * 5/2002 Asakura ..... A63B 37/0004 473/378

(Continued)

FOREIGN PATENT DOCUMENTS

JP 2010-188199 A 9/2010

*Primary Examiner* — Alvin Hunter
(74) *Attorney, Agent, or Firm* — Birch, Stewart, Kolasch & Birch, LLP

(57) ABSTRACT

A golf ball has a large number of dimples 10 on a surface thereof. The dimples 10 include a plurality of small dimples 10S each having an area of less than 8.0 $mm^2$, and a plurality of large dimples 10L each having an area of equal to or greater than 8.0 $mm^2$. A ratio PS of a sum of areas of all the small dimples 10S to a surface area of a phantom sphere of the golf ball is less than 2.0%. A ratio PL of a sum of areas of all the large dimples 10L to the surface area of the phantom sphere is equal to or greater than 79.0%. A degree G of uniformity of areas of the large dimples 10L is equal to or less than 1.15.

12 Claims, 28 Drawing Sheets

(56) References Cited

U.S. PATENT DOCUMENTS

| | | | | |
|---|---|---|---|---|
| 6,454,668 | B2 * | 9/2002 | Kasashima | A63B 37/0004 473/351 |
| 6,609,983 | B2 * | 8/2003 | Winfield | A63B 37/0004 473/378 |
| 6,719,647 | B2 * | 4/2004 | Sajima | A63B 37/0004 473/378 |
| 6,761,647 | B2 * | 7/2004 | Kasashima | A63B 37/0004 473/378 |
| 7,169,066 | B2 * | 1/2007 | Sajima | A63B 37/0004 473/378 |
| 7,938,745 | B2 * | 5/2011 | Sullivan | A63B 37/0003 473/378 |
| 2007/0149321 | A1 | 6/2007 | Sajima | |
| 2007/0173354 | A1 | 7/2007 | Sajima | |
| 2009/0191982 | A1 | 7/2009 | Kim et al. | |
| 2012/0004053 | A1 | 1/2012 | Kim | |
| 2013/0196791 | A1 | 8/2013 | Sajima et al. | |

* cited by examiner

GOLF BALL

This application claims priority on Patent Application No. 2014-263836, Patent Application No. 2014-264075, and Patent Application No. 2014-264293 filed in JAPAN on Dec. 26, 2014. The entire contents of these Japanese Patent Applications are hereby incorporated by reference.

BACKGROUND OF THE INVENTION

Field of the Invention

The present invention relates to golf balls. Specifically, the present invention relates to improvement of dimples of golf balls.

Description of the Related Art

The greatest interest to golf players concerning golf balls is flight distance. Golf players place importance on flight distance particularly in a shot with a driver. There have been proposals for improvement of flight performance. JP2010-188199 discloses a golf ball that includes a core having a great surface hardness and a small central hardness.

Another interest to golf players concerning golf balls is feel at impact. Generally, players prefer soft feel at impact. Players place importance on feel at impact particularly in shots with a middle iron and with a short iron.

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

There have been various proposals for dimples. JP2009-172192 (US2009/0191982) discloses a golf ball that has randomly arranged dimples. The dimple pattern of the golf ball is referred to as a random pattern. The random pattern can contribute to flight performance of the golf ball. JP2012-10822 (US2012/0004053) also discloses a golf ball having a random pattern.

JP2007-175267 (US2007/0149321) discloses a dimple pattern in which the number of units present in a high-latitude region is different from the number of units present in a low-latitude region. JP2007-195591 (US2007/0173354) discloses a dimple pattern in which the number of types of dimples present in a low-latitude region is greater than the number of types of dimples present in a high-latitude region. JP2013-153966 (US2013/0196791) discloses a dimple pattern in which the density of dimples is high and variations in sizes of dimples are small.

The greatest interest to golf players concerning golf balls is flight performance. Golf players desire golf balls having excellent flight performance. In light of flight performance, there is room for improvement in a dimple pattern.

Golf players also desire golf balls having excellent feel at impact.

Golf players also place importance on flight distance in a shot with an iron club as well as flight distance in a shot with a driver. Players particularly place importance on flight distance in shots with a middle iron and with a long iron. A spin rate of a golf ball in hitting with a middle iron is high. If a conventional golf ball is hit with a middle iron, an excessive lift force is generated. The lift force may cause rising of the golf ball during flight. The rising impairs flight performance. There is room for improvement also in flight performance in hitting with a middle iron.

An object of the present invention is to provide a golf ball having excellent flight performance. Another object of the present invention is to provide a golf ball excellent in both flight performance and feel at impact. Still another object of the present invention is to provide a golf ball excellent in both flight performance and feel at impact in hitting with a middle iron.

SUMMARY OF THE INVENTION

A golf ball according to the present invention has a large number of dimples on a surface thereof. The dimples include a plurality of small dimples each having an area of smaller than 8.0 $mm^2$, and a plurality of large dimples each having an area of equal to or greater than 8.0 $mm^2$. A ratio PS of a sum of areas of all the small dimples to a surface area of a phantom sphere of the golf ball is less than 2.0%. A ratio PL of a sum of areas of all the large dimples to the surface area of the phantom sphere of the golf ball is equal to or greater than 79.0%. A degree G of uniformity of areas ($mm^2$) of the large dimples is equal to or less than 1.15.

The golf ball according to the present invention includes the small dimples. The small dimples suppress distortion of a dimple pattern. Since the ratio PS is less than 2.0%, the distribution of sizes of dimples is not considerably varied by the small dimples. In the golf ball, a long flight distance is obtained because of a synergistic effect of a small distortion of the pattern and small variations in sizes of the dimples.

Preferably, the ratio PS is equal to or greater than 0.7%. Preferably, the number NS of the small dimples is equal to or greater than 6 but equal to or less than 20. Preferably, a ratio (NS/N) of the number NS of the small dimples to the total number N of the dimples is equal to or greater than 0.01 but equal to or less than 0.07.

Preferably, each dimple has a depth of the deepest portion from a surface of the phantom sphere of equal to or greater than 0.10 mm but equal to or less than 0.65 mm.

Preferably, a total volume of the dimples is equal to or greater than 450 $mm^3$ but equal to or less than 750 $mm^3$.

Preferably, the ratio PL is equal to or greater than 79.5% and the degree G of uniformity is equal to or less than 1.10.

Preferably, the ratio PL is equal to or greater than 80.0% and the degree G of uniformity is equal to or less than 1.05.

The golf ball may include a core, one or more mid layers positioned outside the core, and a cover positioned outside the mid layers. The cover has a Shore D hardness greater than a Shore D hardness of each mid layer. An average THm of products obtained by multiplying a thickness (mm) by a hardness (Shore D) for each of the mid layers, and a product THc obtained by multiplying a thickness (mm) by a hardness (Shore D) for the cover satisfy the following mathematical formula.

$$THc-THm\leq 50$$

In the golf ball, a spin rate in hitting with a driver is low. In the golf ball, an energy loss is low. The golf ball also has an excellent aerodynamic characteristic. In the golf ball, a long flight distance can be obtained by a synergistic effect of the low energy loss and the excellent aerodynamic characteristic. Furthermore, the golf ball has an excellent feel at impact. Preferably, the product THm and the product THc satisfy the following mathematical formula.

$$-50\leq THc-THm$$

The Shore D hardness of the cover may be smaller than the Shore D hardness of each mid layer. The average THm of products obtained by multiplying a thickness (mm) by a hardness (Shore D) for each mid layer, and the product THc obtained by multiplying a thickness (mm) by a hardness (Shore D) for the cover satisfy the following mathematical formula.

$$-60 \leq THc - THm$$

The golf ball has a dimple pattern excellent in aerodynamic characteristic. The spin rate of the golf ball in hitting with a middle iron is low. If the golf ball is hit with a middle iron, rising of the golf ball during flight is less likely to occur since an excessive lift force is not generated. The golf ball also has an excellent feel at impact in hitting with a middle iron. Preferably, the product THm and the product THc satisfy the following mathematical formula.

$$THc - THm \leq 40$$

DESCRIPTION OF THE PREFERRED EMBODIMENTS

The following will describe in detail the present invention, based on preferred embodiments with reference to the accompanying drawings.

First Embodiment

Figure 1:
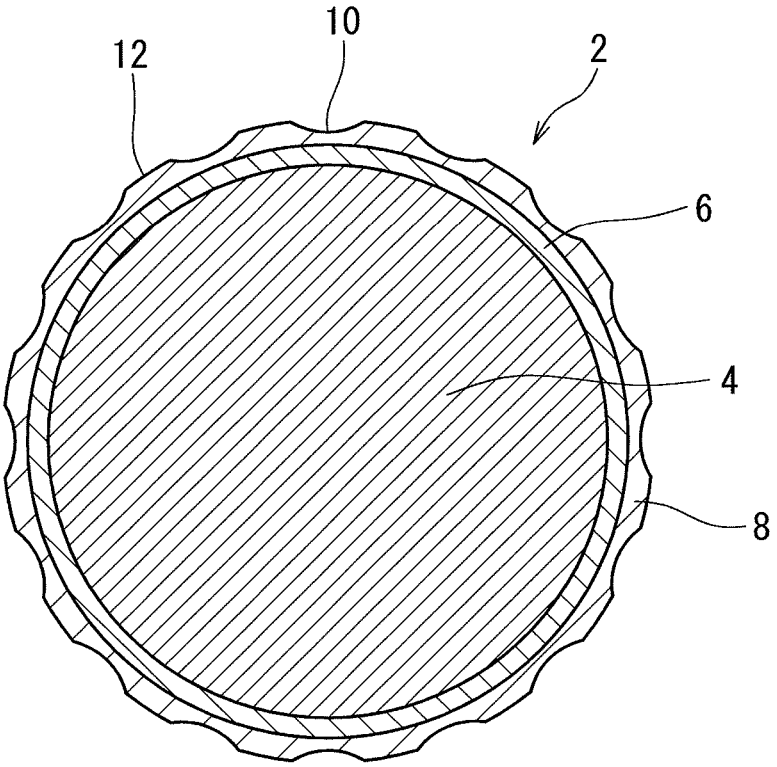
FIG. 1 is a cross-sectional view of a golf ball according to one embodiment of the present invention.

A golf ball 2 shown in FIG. 1 includes a spherical core 4, a mid layer 6 positioned outside the core 4, and a cover 8 positioned outside the mid layer 6. The golf ball 2 has a large number of dimples 10 on a surface thereof. Of the surface of the golf ball 2, a part other than the dimples 10 is a land 12. The golf ball 2 includes a paint layer and a mark layer on the external side of the cover 8 although these layers are not shown in the drawing. The golf ball 2 may include another layer between the core 4 and the mid layer 6. The golf ball 2 may include another layer between the mid layer 6 and the cover 8.

The golf ball 2 has a diameter of preferably equal to or greater than 40 mm but equal to or less than 45 mm. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 has a weight of preferably equal to or greater than 40 g but equal to or less than 50 g. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of preferable base rubbers of the rubber composition include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred that the polybutadiene is a principal component. Specifically, the proportion of the polybutadiene to the entire base rubber is preferably equal to or greater than 50% by weight and particularly preferably equal to or greater than 80% by weight. A polybutadiene in which the proportion of cis-1,4 bonds is equal to or greater than 80% is particularly preferred.

The rubber composition of the core 4 preferably includes a co-crosslinking agent. Preferable co-crosslinking agents in light of resilience performance are monovalent or bivalent metal salts of an α,β-unsaturated carboxylic acid having 2 to 8 carbon atoms. Examples of preferable co-crosslinking agents include zinc acrylate, magnesium acrylate, zinc methacrylate, and magnesium methacrylate. In light of resilience performance, zinc acrylate and zinc methacrylate are particularly preferred.

The rubber composition may include a metal oxide and an α,β-unsaturated carboxylic acid having 2 to 8 carbon atoms. They both react with each other in the rubber composition to obtain a salt. The salt serves as a co-crosslinking agent. Examples of preferable α,β-unsaturated carboxylic acids include acrylic acid and methacrylic acid. Examples of preferable metal oxides include zinc oxide and magnesium oxide.

In light of resilience performance of the golf ball 2, the amount of the co-crosslinking agent per 100 parts by weight of the base rubber is preferably equal to or greater than 10 parts by weight and particularly preferably equal to or greater than 15 parts by weight. In light of soft feel at impact, the amount is preferably equal to or less than 50 parts by weight and particularly preferably equal to or less than 45 parts by weight.

Preferably, the rubber composition of the core 4 includes an organic peroxide. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. An organic peroxide with particularly high versatility is dicumyl peroxide.

In light of resilience performance of the golf ball 2, the amount of the organic peroxide per 100 parts by weight of the base rubber is preferably equal to or greater than 0.1 parts by weight, more preferably equal to or greater than 0.3 parts by weight, and particularly preferably equal to or greater than 0.5 parts by weight. In light of soft feel at impact, the amount is preferably equal to or less than 3.0 parts by weight, more preferably equal to or less than 2.8 parts by weight, and particularly preferably equal to or less than 2.5 parts by weight.

Preferably, the rubber composition of the core 4 includes an organic sulfur compound. Organic sulfur compounds include naphthalenethiol type compounds, benzenethiol type compounds, and disulfide type compounds.

Examples of naphthalenethiol type compounds include 1-naphthalenethiol, 2-naphthalenethiol(2-thionaphthol), 4-chloro-1-naphthalenethiol, 4-bromo-1-naphthalenethiol, 1-chloro-2-naphthalenethiol, 1-bromo-2-naphthalenethiol, 1-fluoro-2-naphthalenethiol, 1-cyano-2-naphthalenethiol, and 1-acetyl-2-naphthalenethiol.

Examples of benzenethiol type compounds include benzenethiol, 4-chlorobenzenethiol, 3-chlorobenzenethiol, 4-bromobenzenethiol, 3-bromobenzenethiol, 4-fluorobenzenethiol, 4-iodobenzenethiol, 2,5-dichlorobenzenethiol, 3,5-dichlorobenzenethiol, 2,6-dichlorobenzenethiol, 2,5-dibromobenzenethiol, 3,5-dibromobenzenethiol, 2-chloro-5-bromobenzenethiol, 2,4,6-trichlorobenzenethiol, 2,3,4,5,6-pentachlorobenzenethiol, 2,3,4,5,6-pentafluorobenzenethiol, 4-cyanobenzenethiol, 2-cyanobenzenethiol, 4-nitrobenzenethiol, and 2-nitrobenzenethiol.

Examples of disulfide type compounds include diphenyl disulfide, bis(4-chlorophenyl)disulfide, bis(3-chlorophenyl) disulfide, bis(4-bromophenyl)disulfide, bis(3-bromophenyl) disulfide, bis(4-fluorophenyl)disulfide, bis(4-iodophenyl) disulfide, bis(4-cyanophenyl)disulfide, bis(2,5-dichlorophenyl)disulfide, bis(3,5-dichlorophenyl)disulfide, bis(2,6-dichlorophenyl)disulfide, bis(2,5-dibromophenyl) disulfide, bis(3,5-dibromophenyl)disulfide, bis(2-chloro-5-bromophenyl)disulfide, bis(2-cyano-5-bromophenyl)disulfide, bis(2,4,6-trichlorophenyl)disulfide, bis(2-cyano-4-chloro-6-bromophenyl)disulfide, bis(2,3,5,6-tetrachlorophenyl)disulfide, bis(2,3,4,5,6-pentachlorophenyl)disulfide, and bis(2,3,4,5,6-pentabromophenyl)disulfide.

In light of resilience performance of the golf ball 2, the amount of the organic sulfur compound per 100 parts by weight of the base rubber is preferably equal to or greater than 0.1 parts by weight and particularly preferably equal to or greater than 0.2 parts by weight. In light of soft feel at impact, the amount is preferably equal to or less than 1.5 parts by weight, more preferably equal to or less than 1.0 parts by weight, and particularly preferably equal to or less than 0.8 parts by weight.

Preferably, the rubber composition of the core 4 includes a carboxylate. The core 4 including a carboxylate has a small hardness at a vicinity of the central point. The core 4 has an outer-hard/inner-soft structure. When the golf ball 2 having the core 4 is hit with a driver, the spin rate is low. As detailed later, a long flight distance is obtained in the golf ball 2 having a low spin rate. Examples of preferable carboxylates include zinc octoate and zinc stearate. The amount of the carboxylate per 100 parts by weight of the base rubber is preferably equal to or greater than 1 part by weight but equal to or less than 20 parts by weight.

The rubber composition of the core 4 may include a filler for the purpose of adjusting specific gravity and the like. Examples of suitable fillers include zinc oxide, barium sulfate, calcium carbonate, and magnesium carbonate. The amount of the filler is determined as appropriate so that the intended specific gravity of the core 4 is accomplished. The rubber composition may include various additives such as sulfur, an anti-aging agent, a coloring agent, a plasticizer, a dispersant, and the like in an adequate amount. Crosslinked rubber powder or synthetic resin powder may also be included in the rubber composition.

The core 4 has a diameter of preferably equal to or greater than 33.0 mm. The golf ball 2 that includes the core 4 having a diameter of 33.0 mm or greater is excellent in resilience performance. In this respect, the diameter is more preferably equal to or greater than 34.0 mm, and particularly preferably equal to or greater than 35.0 mm. From the standpoint that the mid layer 6 and the cover 8 can have a sufficient thickness, the diameter is preferably equal to or less than 40.0 mm.

The core 4 has a weight of preferably equal to or greater than 10 g but equal to or less than 40 g. The temperature for crosslinking the core 4 is equal to or higher than 140° C. but equal to or lower than 180° C. The time period for crosslinking the core 4 is equal to or longer than 10 minutes but equal to or shorter than 60 minutes. The core 4 may include two or more layers. The core 4 may have a rib on the surface thereof. The core 4 may be hollow.

The mid layer 6 is positioned between the core 4 and the cover 8. The mid layer 6 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferred. Ionomer resins are highly elastic. The golf ball 2 that has the mid layer 6 including an ionomer resin is excellent in resilience performance.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 70% by weight, and particularly preferably equal to or greater than 85% by weight.

Examples of preferable ionomer resins include binary copolymers formed with an α-olefin and an α,β-unsaturated carboxylic acid having 3 to 8 carbon atoms. A preferable binary copolymer contains 80% by weight or more but 90% by weight or less of an α-olefin, and 10% by weight or more but 20% by weight or less of an α,β-unsaturated carboxylic acid. The binary copolymer is excellent in resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer contains 70% by weight or more but 85% by weight or less of an α-olefin, 5% by weight or more but 30% by weight or less of an α,β-unsaturated carboxylic acid, and 1% by weight or more but 25% by weight or less of an α,β-unsaturated carboxylate ester. The ternary copolymer is excellent in resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid. Another particularly preferable ionomer resin is a copolymer formed with ethylene and methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7329", and "Himilan AM7337", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation. Two or more ionomer resins may be used in combination.

The resin composition of the mid layer 6 may include a styrene block-containing thermoplastic elastomer. The styrene block-containing thermoplastic elastomer includes a polystyrene block as a hard segment, and a soft segment. A typical soft segment is a diene block. Examples of compounds for the diene block include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, styrene block-containing thermoplastic elastomers include an alloy of an olefin and one or more members selected from the group consisting of SBS, SIS, SIBS, SEBS, SEPS, and SEEPS. The olefin component in the alloy is presumed to contribute to improvement of compatibility with another base polymer. This alloy can contribute to the resilience performance of the golf ball 2. An olefin having 2 to 10 carbon atoms is preferred. Examples of suitable olefins include ethylene, propylene, butene, and pentene. Ethylene and propylene are particularly preferred.

Specific examples of polymer alloys include trade names "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N", and "Rabalon SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "Septon HG-252" manufactured by Kuraray Co., Ltd.

In light of feel at impact, the proportion of the styrene block-containing thermoplastic elastomer to the entire base polymer is preferably equal to or greater than 5% by weight, more preferably equal to or greater than 10% by weight, and particularly preferably equal to or greater than 15% by weight. In light of resilience performance of the golf ball 2, the proportion is preferably equal to or less than 40% by weight, more preferably equal to or less than 30% by weight, and particularly preferably equal to or less than 25% by weight.

The resin composition of the mid layer 6 may include a filler for the purpose of adjusting specific gravity and the like. Examples of suitable fillers include zinc oxide, barium sulfate, calcium carbonate, and magnesium carbonate. The resin composition may include powder of a metal with a high specific gravity as a filler. Specific examples of metals with a high specific gravity include tungsten and molybdenum. The amount of the filler is determined as appropriate so that the intended specific gravity of the mid layer 6 is accomplished. A coloring agent, crosslinked rubber powder, or synthetic resin powder may also be included in the resin composition.

The mid layer 6 has a hardness Hm of preferably equal to or greater than 40 but equal to or less than 60. The golf ball 2 that includes the mid layer 6 having a hardness Hm of 40 or greater is excellent in resilience performance. In this respect, the hardness Hm is more preferably equal to or greater than 45, and particularly preferably equal to or greater than 48. The golf ball 2 that includes the mid layer 6 having a hardness Hm of 60 or less is excellent in feel at impact. In this respect, the hardness Hm is more preferably equal to or less than 55, and particularly preferably equal to or less than 52.

The hardness Hm of the mid layer 6 and a hardness Hc of the cover 8 are measured according to the standards of "ASTM-D 2240-68". For the measurement, an automated rubber-hardness measurement machine (trade name "P1" manufactured by Kobunshi Keiki Co., Ltd.), to which a Shore D type hardness scale is mounted, is used. For the measurement, a sheet that is formed by hot press, is formed from the same material as that of the mid layer 6 (or the cover 8), and has a thickness of approximately 2 mm is used. Prior to the measurement, the sheet is kept at 23° C. for two weeks. At the measurement, three sheets are stacked.

The mid layer 6 has a thickness Tm of preferably equal to or greater than 0.3 mm but equal to or less than 2.5 mm. The golf ball 2 that includes the mid layer 6 having a thickness Tm of 0.3 mm or greater is excellent in feel at impact. In this respect, the thickness Tm is more preferably equal to or greater than 0.5 mm, and particularly preferably equal to or greater than 0.8 mm. The golf ball 2 that includes the mid layer 6 having a thickness Tm of 2.5 mm or less is excellent in resilience performance. In this respect, the thickness Tm is more preferably equal to or less than 2.0 mm, and particularly preferably equal to or less than 1.8 mm.

The golf ball 2 may include two or more mid layers positioned between the core 4 and the cover 8. In this case, it is preferred that each mid layer has a thickness falling within the above range.

The cover 8 is the outermost layer except the mark layer and the paint layer. The cover 8 is formed from a thermoplastic resin composition. A preferable base polymer of the resin composition is an ionomer resin. The golf ball 2 that has the cover 8 including an ionomer resin is excellent in resilience performance. The ionomer resins mentioned above for the mid layer 6 can be used for the cover 8.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 60% by weight, and particularly preferably equal to or greater than 70% by weight.

A preferable resin that can be used in combination with an ionomer resin is an ethylene-(meth)acrylic acid copolymer. The copolymer is obtained by a copolymerization reaction of a monomer composition that contains ethylene and (meth) acrylic acid. In the copolymer, some of the carboxyl groups are neutralized with metal ions. The copolymer includes 3% by weight or more but 25% by weight or less of a (meth) acrylic acid component. An ethylene-(meth)acrylic acid copolymer having a polar functional group is particularly preferred. A specific example of ethylene-(meth)acrylic acid copolymers is trade name "NUCREL" manufactured by Du Pont-MITSUI POLYCHEMICALS Co., Ltd.

The resin composition of the cover 8 may include a coloring agent such as titanium dioxide and a fluorescent pigment, a filler such as barium sulfate, a dispersant, an antioxidant, an ultraviolet absorber, a light stabilizer, a fluorescent material, a fluorescent brightener, and the like in an adequate amount.

The cover 8 has a Shore D hardness Hc of preferably equal to or greater than 50 but equal to or less than 70. The golf ball 2 that includes the cover 8 having a hardness Hc of 50 or greater is excellent in resilience performance. The golf ball 2 has excellent flight performance. In this respect, the hardness Hc is more preferably equal to or greater than 53 and particularly preferably equal to or greater than 55. The golf ball 2 that includes the cover 8 having a hardness Hc of 70 or less is excellent in feel at impact. In this respect, the hardness Hc is more preferably equal to or less than 67 and particularly preferably equal to or less than 65.

The cover 8 has a thickness Tc of preferably equal to or greater than 0.3 mm but equal to or less than 2.5 mm. The golf ball 2 that includes the cover 8 having a thickness Tc of 0.3 mm or greater is excellent in resilience performance. In this respect, the thickness Tc is more preferably equal to or greater than 0.5 mm and particularly preferably equal to or greater than 0.8 mm. The golf ball 2 that includes the cover 8 having a thickness Tc of 2.5 mm or less is excellent in feel at impact. In this respect, the thickness Tc is more preferably equal to or less than 2.3 mm and particularly preferably equal to or less than 2.0 mm.

For forming the cover 8, known methods such as injection molding, compression molding, and the like can be used. When forming the cover 8, the dimples 10 are formed by pimples formed on the cavity face of a mold.

The hardness Hc of the cover 8 is preferably greater than the hardness Hm of the mid layer 6. In the golf ball 2 in which the hardness Hc is greater than the hardness Hm, spin can be suppressed. The golf ball 2 has excellent flight performance in a shot with a driver. Preferably, the hardness Hc of the cover 8 is greater than hardnesses of any other layers.

In light of flight performance, a difference (Hc−Hm) between the hardness Hc and the hardness Hm is preferably equal to or greater than 2 and particularly preferably equal to or greater than 5. The difference (Hc−Hm) is preferably equal to or less than 20.

In the golf ball 2 having two or more mid layers 6, the hardness Hc of the cover 8 is preferably greater than a Shore D hardness of each of the mid layers 6. The difference between the hardness Hc of the cover 8 and the hardness of each mid layer 6 is preferably equal to or greater than 2 and particularly preferably equal to or greater than 5. The difference is preferably equal to or less than 20.

The thickness Tm of the mid layer 6 is preferably greater than the thickness Tc of the cover 8. The mid layer 6 can suppress spin. In the golf ball 2 having two or more mid layers 6, a total thickness of the mid layers 6 is preferably greater than the thickness Tc of the cover 8.

A sum of the thickness Tm of the mid layer 6 and the thickness Tc of the cover 8 is preferably equal to or less than 4.0 mm. The golf ball 2 having the sum of 4.0 mm or less is excellent in feel at impact. In this respect, the sum is more preferably equal to or less than 3.8 mm and particularly preferably equal to or less than 3.6 mm. The sum is preferably equal to or greater than 1.0 mm.

A product THm of the thickess Tm (mm) and the hardness Hm (Shore D) for the mid layer 6, and a product THc of the thickness Tc (mm) and the hardness Hc (Shore D) for the cover 8 satisfy the following mathematical formula (1).

$$THc-THm\ 50 \quad (1)$$

When the golf ball 2 that satisfies the mathematical formula (1) is hit with a driver, the spin rate is low. When the golf ball 2 is hit with a driver, an excessive lift force is not generated. The golf ball 2 has an excellent flight performance in a shot with a driver. In respect of flight performance, the difference (THc−THm) is more preferably equal to or less than 40, and particularly preferably equal to or less than 30.

Preferably, the golf ball 2 satisfies the following mathematical formula (2).

$$-50 \leq THc-THm \quad (2)$$

When the golf ball 2 that satisfies the mathematical formula (2) is hit with a driver, soft feel at impact is attained. In respect of feel at impact, the difference (THc−THm) is more preferably equal to or greater than −40, and particularly preferably equal to or greater than −30.

In the golf ball 2 having two or more mid layers 6, the product of the thickness Tm (mm) and the hardness Hm (Shore D) is calculated for each of the mid layers 6. The average of the products is the product THm.

As shown in FIGS. 2 to 7, the contour of each dimple 10 is circular. The golf ball 2 has dimples A each having a diameter of 4.50 mm; dimples B each having a diameter of 4.40 mm; dimples C each having a diameter of 4.30 mm;

dimples D each having a diameter of 4.20 mm; and dimples E each having a diameter of 3.00 mm. The number of types of the dimples 10 is five. The golf ball 2 may have non-circular dimples instead of the circular dimples 10 or together with the circular dimples 10.

The number of the dimples A is 80; the number of the dimples B is 74; the number of the dimples C is 62; the number of the dimples D is 96; and the number of the dimples E is 12. The total number of the dimples 10 is 324. A dimple pattern is formed by the dimples 10 and the land 12.

Figure 8:
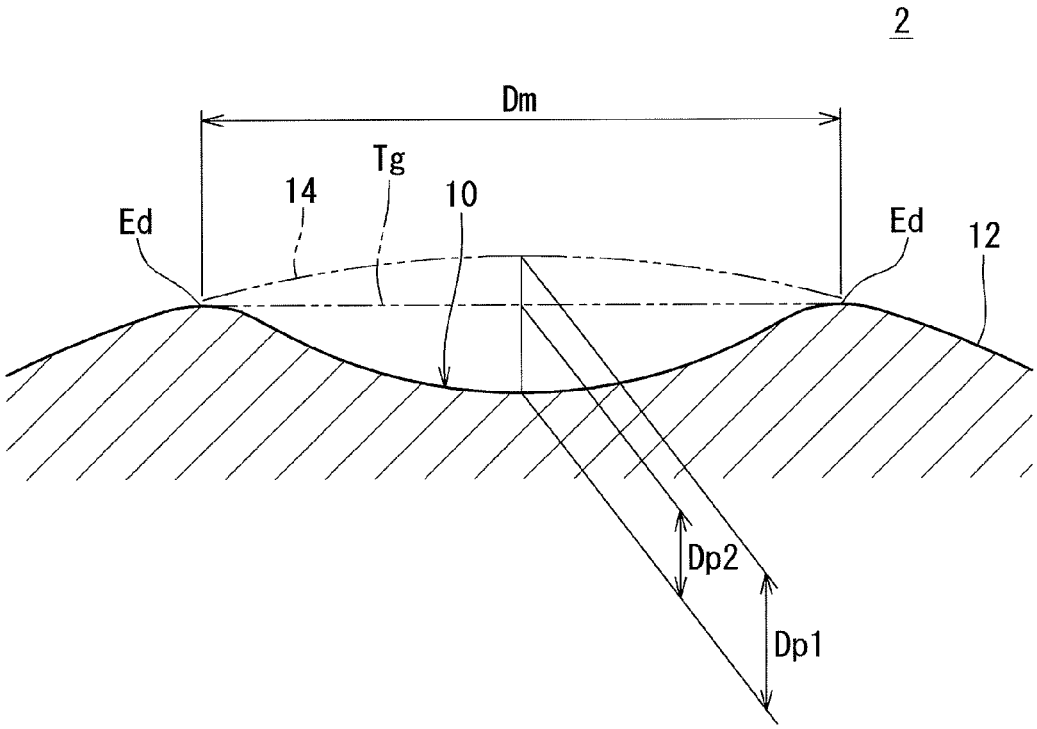
FIG. 8 is a partially enlarged cross-sectional view of the golf ball in FIG. 1.

FIG. 8 shows a cross section of the golf ball 2 along a plane passing through the center of the dimple 10 and the center of the golf ball 2. In FIG. 8, the top-to-bottom direction is the depth direction of the dimple 10. In FIG. 8, what is indicated by a chain double-dashed line 14 is a phantom sphere. The surface of the phantom sphere 14 is the surface of the golf ball 2 when it is postulated that no dimple 10 exists. The diameter of the phantom sphere 14 is the same as the diameter of the golf ball 2. The dimple 10 is recessed from the surface of the phantom sphere 14. The land 12 coincides with the surface of the phantom sphere 14. In the present embodiment, the cross-sectional shape of each dimple 10 is substantially a circular arc.

In FIG. 8, what is indicated by a double ended arrow Dm is the diameter of the dimple 10. The diameter Dm is a distance between two tangent points Ed appearing on a tangent line Tg that is drawn tangent to the far opposite ends of the dimple 10. Each tangent point Ed is also the edge of the dimple 10. The edge Ed defines the contour of the dimple 10. In FIG. 8, what is indicated by a double ended arrow Dp1 is a first depth of the dimple 10. The first depth Dp1 is a distance between the deepest portion of the dimple 10 and the surface of the phantom sphere 14. In FIG. 8, what is indicated by a double ended arrow Dp2 is a second depth of the dimple 10. The second depth Dp2 is a distance between the deepest portion of the dimple 10 and the tangent line Tg.

The diameter Dm of each dimple 10 is preferably equal to or greater than 2.0 mm but equal to or less than 6.0 mm. The dimple 10 having a diameter Dm of equal to or greater than 2.0 mm contributes to turbulization. In this respect, the diameter Dm is more preferably equal to or greater than 2.5 mm and particularly preferably equal to or greater than 2.8 mm. The dimple 10 having a diameter Dm of equal to or less than 6.0 mm does not impair a fundamental feature of the golf ball 2 being substantially a sphere. In this respect, the diameter Dm is more preferably equal to or less than 5.5 mm and particularly preferably equal to or less than 5.0 mm.

In light of suppression of rising of the golf ball 2 during flight, the first depth Dp1 of each dimple 10 is preferably equal to or greater than 0.10 mm, more preferably equal to or greater than 0.13 mm, and particularly preferably equal to or greater than 0.15 mm. In light of suppression of dropping of the golf ball 2 during flight, the first depth Dp1 is preferably equal to or less than 0.65 mm, more preferably equal to or less than 0.60 mm, and particularly preferably equal to or less than 0.55 mm.

An area s of the dimple 10 is the area of a region surrounded by the contour line of the dimple 10 when the center of the golf ball 2 is viewed at infinity. In case of a circular dimple 10, the area S is calculated by the following formula.

$$S=(Dm/2)^2*n$$

In the golf ball 2 shown in FIGS. 2 to 7, the area of each dimple A is 15.9 $mm^2$; the area of each dimple B is 15.2 $mm^2$; the area of each dimple C is 14.5 $mm^2$; the area of each dimple D is 13.9 $mm^2$; and the area of each dimple E is 7.1 $mm^2$.

In the present invention, the ratio of the sum of the areas S of all the dimples 10 to the surface area of the phantom sphere 14 is referred to as an occupation ratio. From the standpoint that a sufficient turbulization can be obtained, the occupation ratio is preferably equal to or greater than 80%, more preferably equal to or greater than 81%, and particularly preferably equal to or greater than 82%. The occupation ratio is preferably equal to or less than 95%. In the golf ball 2 shown in FIGS. 2 to 7, the total area of the dimples 10 is 4712.8 $mm^2$. The surface area of the phantom sphere 14 of the golf ball 2 is 5728.0 $mm^2$, and thus the occupation ratio is 82.3%.

From the standpoint that a sufficient occupation ratio is achieved, the total number N of the dimples 10 is preferably equal to or greater than 250, more preferably equal to or greater than 280, and particularly preferably equal to or greater than 300. From the standpoint that each dimple 10 can contribute to turbulization, the total number N is preferably equal to or less than 450, more preferably equal to or less than 400, and particularly preferably equal to or less than 380.

In the present invention, the "volume of the dimple" means the volume of a portion surrounded by the surface of the phantom sphere 14 and the surface of the dimple 10. In light of suppression of rising of the golf ball 2 during flight, the total volume of the dimples 10 is preferably equal to or greater than 450 $mm^3$, more preferably equal to or greater than 480 $mm^3$, and particularly preferably equal to or greater than 500 $mm^3$. In light of suppression of dropping of the golf ball 2 during flight, the total volume is preferably equal to or less than 750 $mm^3$, more preferably equal to or less than 730 $mm^3$, and particularly preferably equal to or less than 710 $mm^3$.

In the present invention, a dimple 10 having an area of less than 8.0 $mm^2$ is referred to as a "small dimple 10S". In the golf ball 2 shown in FIGS. 2 to 7, the dimples E are the small dimples 10S. In the golf ball 2, the number NS of the small dimples 10S is 12.

In the present invention, a dimple 10 having an area of equal to or greater than 8.0 $mm^2$ is referred to as a "large dimple 10L". In the golf ball 2 shown in FIGS. 2 to 7, the dimples A to D are the large dimples 10L. In the golf ball 2, the number NL of the large dimples 10L is 312. The sum of the number NS and the number NL is equal to the total number N.

In a dimple pattern having only the large dimples 10L, the land 12 on the surface of the phantom sphere 14 tends to become mal-distributed. In the present specification, this mal-distribution is referred to as distortion. In the golf ball 2 according to the present invention, the small dimples 10S suppress the distortion. In the golf ball 2, the small dimples 10S facilitate turbulization. The flight distance of the golf ball 2 is great.

In a pattern in which the small dimples 10S are excessively present, variations in sizes of the dimples 10 are great. In the pattern having great variations, turbulization is insufficient. A sufficient turbulization can be obtained in the golf ball 2 that has an appropriate number of the small dimples 10S. The flight distance of the golf ball 2 having an appropriate number of the small dimples 10S is great.

In light of flight distance, a ratio PS of the sum of areas of all the small dimples 10S to the surface area of the phantom sphere 14 is preferably equal to or greater than 0.7%, more preferably equal to or greater than 0.9%, and particularly preferably equal to or greater than 1.0%. In light of fight distance, the ratio PS is preferably less than 2.0%, more preferably equal to or less than 1.8%, and particularly preferably equal to or less than 1.7%. In the golf ball 2 shown in FIGS. 2 to 7, the ratio PS is 1.5%.

In light of flight distance, the number NS of the small dimples 10S is preferably equal to or greater than 6, more preferably equal to or greater than 8, and particularly preferably equal to or greater than 10. In light of flight distance, the number NS is preferably equal to or less than 20, more preferably equal to or less than 18, and particularly preferably equal to or less than 16.

In light of flight distance, a ratio (NS/N) of the number NS of the small dimples 10S to the total number N of the dimples 10 is preferably equal to or greater than 0.01, more preferably equal to or greater than 0.02, and particularly preferably equal to or greater than 0.03. In light of flight distance, the ratio (NS/N) is preferably equal to or less than 0.07, more preferably equal to or less than 0.06, and particularly preferably equal to or less than 0.05. In the golf ball 2 shown in FIGS. 2 to 7, the ratio (NS/N) is 0.04.

As already mentioned, in light of suppression of the distortion of the dimple pattern, the presence of the small dimples 10S is essential. Meanwhile, a degree of contribution of the small dimples 10S to turbulization is smaller than that of the large dimples 10L. A dimple pattern in which the small dimples 10S are present in an appropriate number and the large dimples 10L are present in a sufficient number is excellent in flight performance.

In light of flight performance, a ratio PL of a sum of areas of all the large dimples 10L to the surface area of the phantom sphere 14 is preferably equal to or greater than 79.0%, more preferably equal to or greater than 79.5%, and particularly preferably equal to or greater than 80.0%. The ratio PL is preferably equal to or less than 90%. In the golf ball 2 shown in FIGS. 2 to 7, the ratio PL is 80.8%.

In a pattern in which variations in sizes of the dimples 10 are great, the turbulization is insufficient. From the standpoint that a sufficient turbulization can be obtained, a degree G of uniformity in areas of the large dimples 10L is preferably equal to or less than 1.15, more preferably equal to or less than 1.10, and particularly preferably equal to or less than 1.05. The degree G of uniformity is preferably equal to or greater than 0.50.

The degree G of uniformity is a standard deviation of areas ($mm^2$) of the large dimples 10L. In the golf ball 2 shown in FIGS. 2 to 7, the average of areas of the large dimples 10L is 14.9 $mm^2$. The degree G of uniformity in the golf ball 2 is calculated based on the following mathematical formula.

$$G=(((15.9-14.9)^2*80+(15.2-14.9)^2*74+(14.5-14.9)^2*62+(13.9-14.9)^2*96)/312)^{1/2}$$

The degree G of uniformity in the golf ball 2 is 0.80.

Second Embodiment

A golf ball 2 according to a second embodiment is shown in FIGS. 1 to 8. The golf ball 2 according to the second embodiment includes a spherical core 4, a mid layer 6 positioned outside the core 4, and a cover 8 positioned outside the mid layer 6, as in the golf ball 2 according to the first embodiment. The golf ball 2 according to the second embodiment has a large number of dimples 10 on the surface thereof. Of the surface of the golf ball 2, a part other than the dimples 10 is a land 12. The golf ball 2 includes a paint layer and a mark layer on the external side of the cover 8 although these layers are not shown in the drawing. The golf ball 2 may include another layer between the core 4 and the mid layer 6. The golf ball 2 may include another layer between the mid layer 6 and the cover 8.

The golf ball 2 has a diameter of preferably equal to or greater than 40 mm but equal to or less than 45 mm. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 has a weight of preferably equal to or greater than 40 g but equal to or less than 50 g. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 has the same specifications as the specifications of the core 4 of the first embodiment.

The mid layer 6 is positioned between the core 4 and the cover 8. The mid layer 6 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferred. Ionomer resins are highly elastic. The golf ball 2 that has the mid layer 6 including an ionomer resin is excellent in resilience performance.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 70% by weight, and particularly preferably equal to or greater than 85% by weight. Ionomer resins mentioned above for the mid layer 6 of the first embodiment can be used also for the mid layer 6 of the second embodiment.

The resin composition of the mid layer 6 may include a styrene block-containing thermoplastic elastomer. Styrene block-containing thermoplastic elastomers mentioned above for the mid layer 6 of the first embodiment can be used also for the mid layer 6 of the second embodiment.

The resin composition of the mid layer 6 may include a polyamide. In the golf ball 2 having the mid layer 6 that includes a polyamide, spin is suppressed. Specific examples of polyamides include polyamide 6, polyamide 11, polyamide 12, polyamide 66, and polyamide 610. In light of versatility, nylon 6 is preferred.

In light of flight performance, the proportion of the polyamide to the entire base polymer is preferably equal to or greater than 10% by weight, more preferably equal to or greater than 20% by weight, and particularly preferably equal to or greater than 30% by weight. In light of feel at impact, the proportion is preferably equal to or less than 50% by weight, more preferably equal to or less than 45% by weight, and particularly preferably equal to or less than 40% by weight.

The resin composition of the mid layer 6 may include a filler for the purpose of adjusting specific gravity and the like. Examples of suitable fillers include zinc oxide, barium sulfate, calcium carbonate, and magnesium carbonate. The resin composition may include powder of a metal with a high specific gravity as a filler. Specific examples of metals with a high specific gravity include tungsten and molybdenum. The amount of the filler is determined as appropriate so that the intended specific gravity of the mid layer 6 is accomplished. A coloring agent, crosslinked rubber powder, or synthetic resin powder may also be included in the resin composition.

The mid layer 6 has a hardness Hm of preferably equal to or greater than 40 but equal to or less than 80. The golf ball 2 that includes the mid layer 6 having a hardness Hm of 40 or greater is excellent in resilience performance. In this respect, the hardness Hm is more preferably equal to or greater than 45, and particularly preferably equal to or greater than 48. The golf ball 2 that includes the mid layer 6 having a hardness Hm of 80 or less is excellent in feel at impact. In this respect, the hardness Hm is more preferably equal to or less than 75, and particularly preferably equal to or less than 73.

The hardness Hm of the mid layer 6 and a hardness Hc of the cover 8 are measured according to the standards of "ASTM-D 2240-68". For the measurement, an automated rubber-hardness measurement machine (trade name "P1" manufactured by Kobunshi Keiki Co., Ltd.), to which a Shore D type hardness scale is mounted, is used. For the measurement, a sheet that is formed by hot press, is formed from the same material as that of the mid layer 6 (or the cover 8), and has a thickness of approximately 2 mm is used. Prior to the measurement, the sheet is kept at 23° C. for two weeks. At the measurement, three sheets are stacked.

The mid layer 6 has a thickness Tm of preferably equal to or greater than 0.3 mm but equal to or less than 2.5 mm. The golf ball 2 that includes the mid layer 6 having a thickness Tm of 0.3 mm or greater is excellent in feel at impact. In this respect, the thickness Tm is more preferably equal to or greater than 0.5 mm, and particularly preferably equal to or greater than 0.8 mm. The golf ball 2 that includes the mid layer 6 having a thickness Tm of 2.5 mm or less is excellent in resilience performance. In this respect, the thickness Tm is more preferably equal to or less than 2.0 mm, and particularly preferably equal to or less than 1.8 mm.

The golf ball 2 may include two or more mid layers positioned between the core 4 and the cover 8. In this case, it is preferred that each mid layer has a thickness falling within the above range.

The cover 8 is the outermost layer except the mark layer and the paint layer. The cover 8 is formed from a thermoplastic resin composition. Preferable base polymer of the resin composition is an ionomer resin. The golf ball 2 that has the cover 8 including an ionomer resin is excellent in resilience performance. The ionomer resins mentioned above for the mid layer 6 of the first embodiment can be used for the cover 8.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 60% by weight, and particularly preferably equal to or greater than 70% by weight.

A preferable resin that can be used in combination with an ionomer resin is an ethylene-(meth)acrylic acid copolymer. The copolymer is obtained by a copolymerization reaction of a monomer composition that contains ethylene and (meth) acrylic acid. In the copolymer, some of the carboxyl groups are neutralized with metal ions. The copolymer includes 3% by weight or more but 25% by weight or less of a (meth) acrylic acid component. An ethylene-(meth)acrylic acid copolymer having a polar functional group is particularly preferred. A specific example of ethylene-(meth)acrylic acid copolymers is trade name "NUCREL" manufactured by Du Pont-MITSUI POLYCHEMICALS Co., Ltd.

Another base polymer suitable for the resin composition of the cover 8 is a polyurethane. The resin composition may include a thermoplastic polyurethane, or may include a thermosetting polyurethane. In light of productivity, the thermoplastic polyurethane is preferable. The thermoplastic polyurethane includes a polyurethane component as a hard segment, and a polyester component or a polyether component as a soft segment. The thermoplastic polyurethane is flexible. The cover 8 for which the polyurethane is used has excellent scuff resistance. When a thermoplastic polyurethane and another resin are used in combination for the cover 8, the proportion of the thermoplastic polyurethane to the entire base resin is preferably equal to or greater than 50% by weight, more preferably equal to or greater than 60% by weight, and particularly preferably equal to or greater than 70% by weight.

The thermoplastic polyurethane has a urethane bond within the molecule. The urethane bond can be formed by reacting a polyol with a polyisocyanate. The polyol, as a material for the urethane bond, has a plurality of hydroxyl groups. Low-molecular-weight polyols and high-molecular-weight polyols can be used.

Examples of low-molecular-weight polyols include diols, triols, tetraols, and hexaols. Specific examples of diols include ethylene glycol, diethylene glycol, triethylene glycol, 1,2-propanediol, 1,3-propanediol, 2-methyl-1,3-propanediol, dipropylene glycol, 1,2-butanediol, 1,3-butanediol, 1,4-butanediol, 2,3-butanediol, 2,3-dimethyl-2,3-butanediol, neopentyl glycol, pentanediol, hexanediol, heptanediol, octanediol, and 1,6-cyclohexanedimethylol. Aniline-based diols or bisphenol A-based diols may be used. Specific examples of triols include glycerin, trimethylol propane, and hexanetriol. Specific examples of tetraols include pentaerythritol and sorbitol.

Examples of high-molecular-weight polyols include polyether polyols such as polyoxyethylene glycol (PEG), polyoxypropylene glycol (PPG), and polytetramethylene ether glycol (PTMG); condensed polyester polyols such as polyethylene adipate (PEA), polybutylene adipate (PBA), and polyhexamethylene adipate (PHMA); lactone polyester polyols such as poly-ε-caprolactone (PCL); polycarbonate polyols such as polyhexamethylene carbonate; and acrylic polyols. Two or more polyols may be used in combination. In light of feel at impact of the golf ball 2, the high-molecular-weight polyol has a number average molecular weight of preferably equal to or greater than 400 and more preferably equal to or greater than 1000. The number average molecular weight is preferably equal to or less than 10000.

Examples of polyisocyanates, as a material for the urethane bond, include aromatic diisocyanates, alicyclic diisocyanates, and aliphatic diisocyanates. Two or more types of diisocyanates may be used in combination.

Examples of aromatic diisocyanates include 2,4-toluene diisocyanate, 2,6-toluene diisocyanate, 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI), and paraphenylene diisocyanate (PPDI). One example of aliphatic diisocyanates is hexamethylene diisocyanate (HDI). Examples of alicyclic diisocyanates include 4,4'-dicyclohexylmethane diisocyanate ($H_{12}MDI$), 1,3-bis (isocyanatemethyl)cyclohexane ($H_6XDI$), isophorone diisocyanate (IPDI), and trans-1,4-cyclohexane diisocyanate (CHDI). 4,4'-dicyclohexylmethane diisocyanate is preferable.

Specific examples of the thermoplastic polyurethane include trade names "Elastollan NY80A", "Elastollan NY82A", "Elastollan NY85A", "Elastollan NY90A", "Elastollan NY95A", "Elastollan NY97A", "Elastollan NY585", and "Elastollan KP016N", manufactured by BASF Japan Ltd.; and trade names "RESAMINE P4585LS" and "RESAMINE PS62490", manufactured by Dainichiseika Color & Chemicals Mfg. Co., Ltd.

The resin composition of the cover 8 may include a coloring agent such as titanium dioxide and a fluorescent pigment, a filler such as barium sulfate, a dispersant, an antioxidant, an ultraviolet absorber, a light stabilizer, a fluorescent material, a fluorescent brightener, and the like in an adequate amount.

The cover 8 has a Shore D hardness Hc of preferably equal to or greater than 35 but equal to or less than 70. In the golf ball 2 that includes the cover 8 having a hardness Hc of 35 or greater, spin in a shot with a middle iron is suppressed. In this respect, the hardness Hc is more preferably equal to or greater than 45 and particularly preferably equal to or greater than 55. The golf ball 2 that includes the cover 8 having a hardness Hc of 70 or less is excellent in feel at impact. In this respect, the hardness Hc is more preferably equal to or less than 67 and particularly preferably equal to or less than 65.

The cover 8 has a thickness Tc of preferably equal to or greater than 0.3 mm but equal to or less than 2.5 mm. The golf ball 2 that includes the cover 8 having a thickness Tc of 0.3 mm or greater is excellent in resilience performance. In this respect, the thickness Tc is more preferably equal to or greater than 0.5 mm and particularly preferably equal to or greater than 0.8 mm. The golf ball 2 that includes the cover 8 having a thickness Tc of 2.5 mm or less is excellent in feel at impact. In this respect, the thickness Tc is more preferably equal to or less than 2.0 mm and particularly preferably equal to or less than 1.8 mm.

For forming the cover 8, known methods such as injection molding, compression molding, and the like can be used. When forming the cover 8, the dimples 10 are formed by pimples formed on the cavity face of a mold.

The golf ball 2 may include a reinforcing layer between the mid layer 6 and the cover 8. The reinforcing layer firmly adheres to the mid layer 6 and also to the cover 8. The reinforcing layer suppresses separation of the cover 8 from the mid layer 6. The reinforcing layer is formed from a resin composition. Examples of preferable base polymers of the reinforcing layer include two-component curing type epoxy resins and two-component curing type urethane resins.

The hardness Hc of the cover 8 is preferably smaller than the hardness Hm of the mid layer 6. The golf ball 2 in which the hardness Hc is smaller than the hardness Hm is excellent in feel at impact. Preferably, the hardness Hc of the cover 8 is smaller than hardnesses of any other layers.

In light of flight performance, a difference (Hm−Hc) between the hardness Hm and the hardness Hc is preferably equal to or greater than 2 and particularly preferably equal to or greater than 5. The difference (Hm−Hc) is preferably equal to or less than 35.

In the golf ball 2 having two or more mid layers 6, the hardness Hc of the cover 8 is preferably smaller than a Shore D hardness of each of the mid layers 6. The difference between the hardness of each mid layer 6 and the hardness Hc of the cover 8 is preferably equal to or greater than 2 and particularly preferably equal to or greater than 5. The difference is preferably equal to or less than 35.

A sum of the thickness Tm of the mid layer 6 and the thickness Tc of the cover 8 is preferably equal to or less than 4.0 mm. The golf ball 2 having the sum of 4.0 mm or less is excellent in feel at impact. In this respect, the sum is more preferably equal to or less than 3.8 mm and particularly preferably equal to or less than 3.6 mm. The sum is preferably equal to or greater than 1.0 mm.

A product THm of the thickess Tm (mm) and the hardness Hm (Shore D) for the mid layer 6, and a product THc of the thickness Tc (mm) and the hardness Hc (Shore D) for the cover 8 satisfy the following mathematical formula (3).

$$-60 \leq THc - THm \quad (3)$$

When the golf ball 2 that satisfies the mathematical formula (3) is hit with a middle iron, the spin rate is low. When the golf ball 2 is hit with a middle iron, an excessive lift force is not generated. The golf ball 2 has an excellent flight performance in a shot with a middle iron. In respect of flight performance, the difference (THc−THm) is more preferably equal to or greater than −50, and particularly preferably equal to or greater than −40.

Preferably, the golf ball 2 satisfies the following mathematical formula (4).

$$THc - THm \leq 40 \quad (4)$$

When the golf ball 2 that satisfies the mathematical formula (4) is hit with a middle iron, soft feel at impact is attained. In respect of feel at impact, the difference (THc−THm) is more preferably equal to or less than 30, and particularly preferably equal to or less than 20.

In a golf ball 2 having two or more mid layers 6, the product of the thickness Tm (mm) and the hardness Hm (Shore D) is calculated for each of the mid layers 6. The average of the products is the product THm.

The golf ball 2 of the second embodiment has the same dimple pattern as the dimple pattern of the golf ball 2 of the first embodiment.

EXAMPLES

[Experiment I]

[Sample 1]

A rubber composition was obtained by kneading 100 parts by weight of a high-cis polybutadiene (trade name "BR-730", manufactured by JSR Corporation), 22.5 parts by weight of zinc diacrylate, 5 parts by weight of zinc oxide, 5 parts by weight of barium sulfate, 0.5 parts by weight of diphenyl disulfide, and 0.6 parts by weight of dicumyl peroxide. This rubber composition was placed into a mold including upper and lower mold halves each having a hemispherical cavity, and heated at 170° C. for 18 minutes to obtain a core with a diameter of 38.5 mm.

A resin composition was obtained by kneading 50 parts by weight of an ionomer resin (trade name "Himilan 1605", manufactured by Du Pont-MITSUI POLYCHEMICALS Co., Ltd.), 50 parts by weight of another ionomer resin ("Himilan AM7329", manufactured by Du Pont-MITSUI POLYCHEMICALS Co., Ltd.), and 4 parts by weight of titanium dioxide with a twin-screw kneading extruder. The core was covered with the resin composition by injection molding to form a mid layer with a thickness of 1.6 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the mid layer with a spray gun, and kept at 23° C. for 6 hours to obtain a reinforcing layer with a thickness of 10 μm.

A resin composition was obtained by kneading 100 parts by weight of a thermoplastic polyurethane elastomer (trade. name "Elastollan XNY85A", manufactured by BASF Japan Ltd.) and 4 parts by weight of titanium dioxide with a twin-screw kneading extruder. Half shells were formed from this resin composition by compression molding. The sphere consisting of the core, the mid layer, and the reinforcing layer was covered with two of these half shells. The sphere and the half shells were placed into a final mold that includes upper and lower mold halves each having a hemispherical cavity and having a large number of pimples on its cavity face, and a cover was obtained by compression molding. The thickness of the cover was 0.5 mm. Dimples having a shape that is the inverted shape of the pimples were formed on the cover. A clear paint including a two-component curing type polyurethane as a base material was applied to this cover to obtain a golf ball of Sample 1 with a diameter of approximately 42.7 mm and a weight of approximately 45.6 g. The amount of compressive deformation of the golf ball in the case where a load was 98 N to 1274 N was 2.45 mm. The specifications of the dimples of the golf ball are shown in Table I.1 below.

[Samples 2 to 15]

Golf balls of Samples 2 to 15 were obtained in the same manner as Sample 1, except the specifications of the dimples were as shown in Tables I.1 to I.5 below. The dimple pattern of the golf ball according to Sample 8 is the same as that of the golf ball according to Comparative Example 2 of JP2005-137692. The dimple pattern of the golf ball according to Sample 9 is the same as that of the golf ball according to Comparative Example 4 of JP2006-20820. The dimple pattern of the golf ball according to Sample 10 is the same as that of the golf ball according to Example 1 of JP2013-153966. The dimple pattern of the golf ball according to Sample 11 is the same as that of the golf ball according to Example 4 of JP2005-137692. The dimple pattern of the golf ball according to Sample 12 is the same as that of the golf ball according to Example 2 of JP2005-137692. The dimple pattern of the golf ball according to Sample 13 is the same as that of the golf ball according to Comparative Example 3 of JP2005-137692.

A driver with a head made of a titanium alloy (trade name "SRIXON Z-TX", manufactured by DUNLOP SPORTS CO. LTD., shaft hardness: X, loft angle: 8.5°) was attached to a swing machine manufactured by Golf Laboratories, Inc. A golf ball was hit under the conditions of: a head speed of 50 m/sec; a launch angle of approximately 10°; and a backspin rate of approximately 2500 rpm, and the distance from the launch point to the stop point was measured. At the test, the weather was almost windless. The average value of data obtained by 20 measurements is shown in Tables I.6 to I.8 below.

TABLE I.1

| Specifications of Dimples | | | | | | | |
|---|---|---|---|---|---|---|---|
| | Number | Diameter (mm) | Dp2 (mm) | Dp1 (mm) | Curvature radius (mm) | Volume ($mm^3$) | Area ($mm^2$) |
| Sample 1 (Type D1) | | | | | | | |
| | A | 82 | 4.55 | 0.135 | 0.2566 | 19.24 | 2.079 | 16.3 |
| | B | 42 | 4.50 | 0.135 | 0.2539 | 18.82 | 2.012 | 15.9 |
| | C | 92 | 4.40 | 0.135 | 0.2487 | 17.99 | 1.884 | 15.2 |
| | D | 34 | 4.30 | 0.135 | 0.2435 | 17.19 | 1.763 | 14.5 |
| | E | 28 | 4.20 | 0.135 | 0.2385 | 16.40 | 1.648 | 13.9 |
| | F | 34 | 4.05 | 0.135 | 0.2313 | 15.26 | 1.486 | 12.9 |
| | G | 12 | 3.00 | 0.135 | 0.1878 | 8.40 | 0.663 | 7.1 |
| Sample 2 (Type D2) | | | | | | | |
| | A | 80 | 4.50 | 0.135 | 0.2539 | 18.82 | 2.012 | 15.9 |
| | B | 74 | 4.40 | 0.135 | 0.2487 | 17.99 | 1.884 | 15.2 |
| | C | 62 | 4.30 | 0.135 | 0.2435 | 17.19 | 1.763 | 14.5 |
| | D | 96 | 4.20 | 0.135 | 0.2385 | 16.40 | 1.648 | 13.9 |
| | E | 12 | 3.00 | 0.135 | 0.1878 | 8.40 | 0.663 | 7.1 |
| Sample 3 (Type D3) | | | | | | | |
| | A | 60 | 4.40 | 0.135 | 0.2487 | 17.99 | 1.884 | 15.2 |
| | B | 158 | 4.30 | 0.135 | 0.2435 | 17.19 | 1.763 | 14.5 |
| | C | 72 | 4.15 | 0.135 | 0.2361 | 16.01 | 1.592 | 13.5 |
| | D | 36 | 3.90 | 0.135 | 0.2242 | 14.15 | 1.336 | 11.9 |
| | E | 12 | 3.00 | 0.135 | 0.1878 | 8.40 | 0.663 | 7.1 |
| Sample 4 (Type D4) | | | | | | | |
| | A | 156 | 4.91 | 0.135 | 0.2766 | 22.39 | 2.609 | 18.9 |
| | B | 98 | 4.65 | 0.135 | 0.2620 | 20.09 | 2.217 | 17.0 |
| | C | 12 | 3.00 | 0.135 | 0.1878 | 8.40 | 0.663 | 7.1 |

TABLE I.2

| Specifications of Dimples | | | | | | | |
|---|---|---|---|---|---|---|---|
| | Number | Diameter (mm) | Dp2 (mm) | Dp1 (mm) | Curvature radius (mm) | Volume ($mm^3$) | Area ($mm^2$) |
| Sample 5 (Type D5) | | | | | | | |
| | A | 70 | 4.10 | 0.135 | 0.2336 | 15.63 | 1.538 | 13.2 |
| | B | 30 | 3.90 | 0.135 | 0.2242 | 14.15 | 1.336 | 11.9 |
| | C | 120 | 3.80 | 0.135 | 0.2197 | 13.44 | 1.243 | 11.3 |
| | D | 170 | 3.70 | 0.135 | 0.2153 | 12.74 | 1.155 | 10.8 |
| | E | 20 | 3.60 | 0.135 | 0.2110 | 12.07 | 1.072 | 10.2 |
| | F | 12 | 2.50 | 0.135 | 0.1716 | 5.85 | 0.422 | 4.9 |
| Sample 6 (Type D6) | | | | | | | |
| | A | 82 | 4.55 | 0.135 | 0.2566 | 19.24 | 2.079 | 16.3 |
| | B | 42 | 4.50 | 0.135 | 0.2539 | 18.82 | 2.012 | 15.9 |
| | C | 92 | 4.40 | 0.135 | 0.2487 | 17.99 | 1.884 | 15.2 |
| | D | 34 | 4.30 | 0.135 | 0.2435 | 17.19 | 1.763 | 14.5 |
| | E | 28 | 4.20 | 0.135 | 0.2385 | 16.40 | 1.648 | 13.9 |
| | F | 32 | 4.05 | 0.135 | 0.2313 | 15.26 | 1.486 | 12.9 |
| | G | 14 | 3.10 | 0.135 | 0.1913 | 8.97 | 0.721 | 7.5 |
| Sample 7 (Type D7) | | | | | | | |
| | A | 80 | 4.50 | 0.135 | 0.2539 | 18.82 | 2.012 | 15.9 |
| | B | 74 | 4.40 | 0.135 | 0.2487 | 17.99 | 1.884 | 15.2 |
| | C | 62 | 4.30 | 0.135 | 0.2435 | 17.19 | 1.763 | 14.5 |
| | D | 96 | 4.20 | 0.135 | 0.2385 | 16.40 | 1.648 | 13.9 |
| | E | 12 | 2.00 | 0.135 | 0.1584 | 3.77 | 0.250 | 3.1 |

TABLE I.3

| Specifications of Dimples | | | | | | | |
|---|---|---|---|---|---|---|---|
| | Number | Diameter (mm) | Dp2 (mm) | Dp1 (mm) | Curvature radius (mm) | Volume ($mm^3$) | Area ($mm^2$) |
| Sample 8 (Type D8) | | | | | | | |
| A | 42 | 4.35 | 0.160 | 0.2711 | 14.86 | 2.009 | 14.9 |
| B | 66 | 4.15 | 0.160 | 0.2611 | 13.54 | 1.762 | 13.5 |
| C | 72 | 3.95 | 0.155 | 0.2465 | 12.66 | 1.508 | 12.3 |
| D | 126 | 3.75 | 0.151 | 0.2335 | 11.72 | 1.287 | 11.0 |
| E | 12 | 3.65 | 0.150 | 0.2281 | 11.18 | 1.192 | 10.5 |
| F | 3 | 2.50 | 0.150 | 0.1866 | 5.28 | 0.459 | 4.9 |
| G | 12 | 2.40 | 0.150 | 0.1838 | 4.88 | 0.417 | 4.5 |
| Sample 9 (Type D9) | | | | | | | |
| A | 132 | 4.95 | 0.137 | 0.2809 | 22.42 | 2.693 | 19.2 |
| B | 78 | 4.50 | 0.139 | 0.2579 | 18.28 | 2.044 | 15.9 |
| C | 36 | 4.20 | 0.137 | 0.2405 | 16.16 | 1.661 | 13.9 |
| D | 12 | 3.90 | 0.132 | 0.2212 | 14.47 | 1.318 | 11.9 |
| E | 12 | 3.10 | 0.130 | 0.1863 | 9.31 | 0.702 | 7.5 |
| Sample 10 (Type D10) | | | | | | | |
| A | 16 | 4.60 | 0.135 | 0.2592 | 19.66 | 2.147 | 16.6 |
| B | 30 | 4.50 | 0.135 | 0.2539 | 18.82 | 2.012 | 15.9 |
| C | 30 | 4.40 | 0.135 | 0.2487 | 17.99 | 1.884 | 15.2 |
| D | 150 | 4.30 | 0.135 | 0.2435 | 17.19 | 1.763 | 14.5 |
| E | 30 | 4.20 | 0.135 | 0.2385 | 16.40 | 1.648 | 13.9 |
| F | 66 | 4.10 | 0.135 | 0.2336 | 15.63 | 1.538 | 13.2 |
| G | 10 | 3.80 | 0.135 | 0.2197 | 13.44 | 1.243 | 11.3 |
| H | 12 | 3.40 | 0.135 | 0.2028 | 10.77 | 0.919 | 9.1 |

TABLE I.4

| Specifications of Dimples | | | | | | | |
|---|---|---|---|---|---|---|---|
| | Number | Diameter (mm) | Dp2 (mm) | Dp1 (mm) | Curvature radius (mm) | Volume ($mm^3$) | Area ($mm^2$) |
| Sample 11 (Type D11) | | | | | | | |
| A | 66 | 4.40 | 0.140 | 0.2537 | 17.36 | 1.923 | 15.2 |
| B | 24 | 4.20 | 0.140 | 0.2435 | 15.82 | 1.682 | 13.9 |
| C | 60 | 4.10 | 0.140 | 0.2386 | 15.08 | 1.571 | 13.2 |
| D | 132 | 3.90 | 0.138 | 0.2272 | 13.85 | 1.354 | 11.9 |
| E | 72 | 3.55 | 0.130 | 0.2039 | 12.18 | 1.007 | 9.9 |
| F | 18 | 2.40 | 0.125 | 0.1588 | 5.82 | 0.359 | 4.5 |
| Sample 12 (Type D12) | | | | | | | |
| A | 66 | 4.55 | 0.135 | 0.2566 | 19.24 | 2.079 | 16.3 |
| B | 24 | 4.35 | 0.130 | 0.2411 | 18.26 | 1.786 | 14.9 |
| C | 60 | 4.25 | 0.125 | 0.2310 | 18.13 | 1.633 | 14.2 |
| D | 132 | 4.05 | 0.125 | 0.2213 | 16.47 | 1.421 | 12.9 |
| E | 72 | 3.70 | 0.125 | 0.2053 | 13.75 | 1.101 | 10.8 |
| F | 18 | 2.55 | 0.125 | 0.1631 | 6.57 | 0.417 | 5.1 |
| Sample 13 (Type D13) | | | | | | | |
| A | 132 | 4.10 | 0.141 | 0.2396 | 14.97 | 1.538 | 13.2 |
| B | 180 | 3.55 | 0.132 | 0.2059 | 12.00 | 1.032 | 9.9 |
| C | 60 | 3.40 | 0.132 | 0.1998 | 11.01 | 0.919 | 9.1 |
| D | 60 | 3.25 | 0.133 | 0.1949 | 9.99 | 0.816 | 8.3 |

TABLE I.5

| Specifications of Dimples | | | | | | | |
|---|---|---|---|---|---|---|---|
| | Number | Diameter (mm) | Dp2 (mm) | Dp1 (mm) | Curvature radius (mm) | Volume ($mm^3$) | Area ($mm^2$) |
| Sample 14 (Type D14) | | | | | | | |
| A | 82 | 4.55 | 0.135 | 0.2566 | 19.24 | 2.079 | 16.3 |
| B | 42 | 4.50 | 0.135 | 0.2539 | 18.82 | 2.012 | 15.9 |
| C | 92 | 4.40 | 0.135 | 0.2487 | 17.99 | 1.884 | 15.2 |

TABLE I.5-continued

| Specifications of Dimples | | | | | | | |
|---|---|---|---|---|---|---|---|
| | Number | Diameter (mm) | Dp2 (mm) | Dp1 (mm) | Curvature radius (mm) | Volume ($mm^3$) | Area ($mm^2$) |
| D | 34 | 4.30 | 0.135 | 0.2435 | 17.19 | 1.763 | 14.5 |
| E | 28 | 4.20 | 0.135 | 0.2385 | 16.40 | 1.648 | 13.9 |
| F | 28 | 4.05 | 0.135 | 0.2313 | 15.26 | 1.486 | 12.9 |
| G | 18 | 3.00 | 0.135 | 0.1878 | 8.40 | 0.663 | 7.1 |
| Sample 15 (Type D15) | | | | | | | |
| A | 60 | 4.40 | 0.135 | 0.2487 | 17.99 | 1.884 | 15.2 |
| B | 158 | 4.30 | 0.135 | 0.2435 | 17.19 | 1.763 | 14.5 |
| C | 72 | 4.15 | 0.135 | 0.2361 | 16.01 | 1.592 | 13.5 |
| D | 36 | 3.90 | 0.135 | 0.2242 | 14.15 | 1.336 | 11.9 |

TABLE I.6

Figure 2:
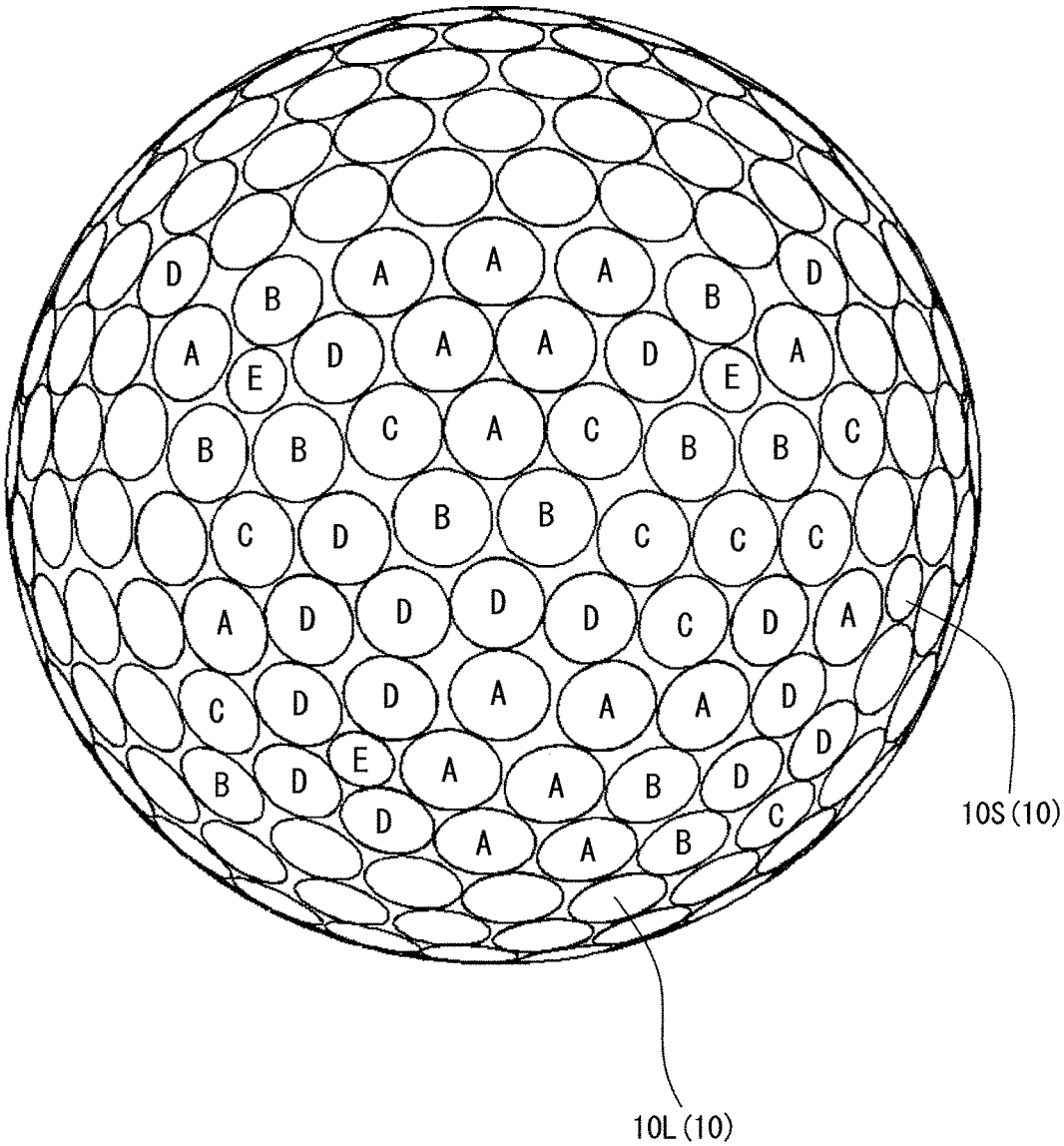
FIG. 2 is an enlarged front view of the golf ball in FIG. 1.
Figure 3:
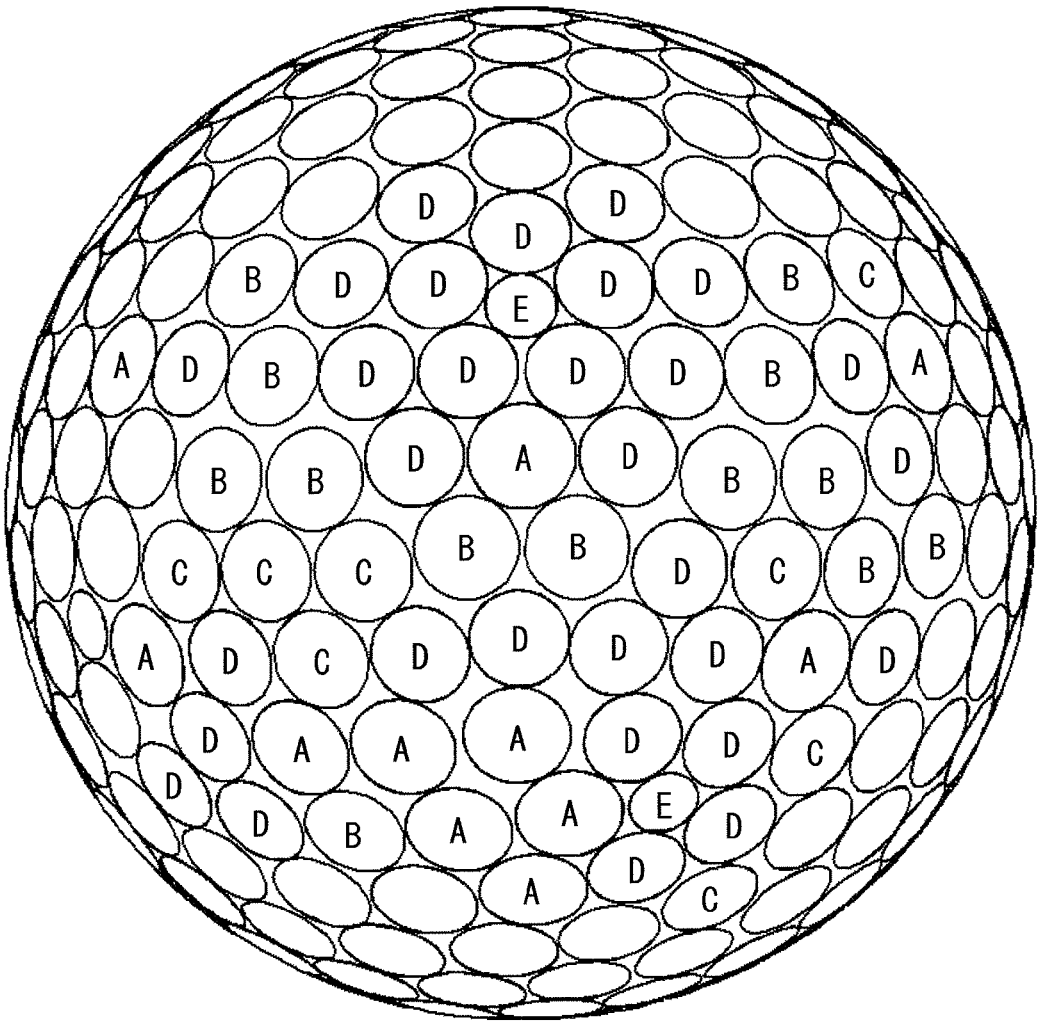
FIG. 3 is a back view of the golf ball in FIG. 2.
Figure 4:
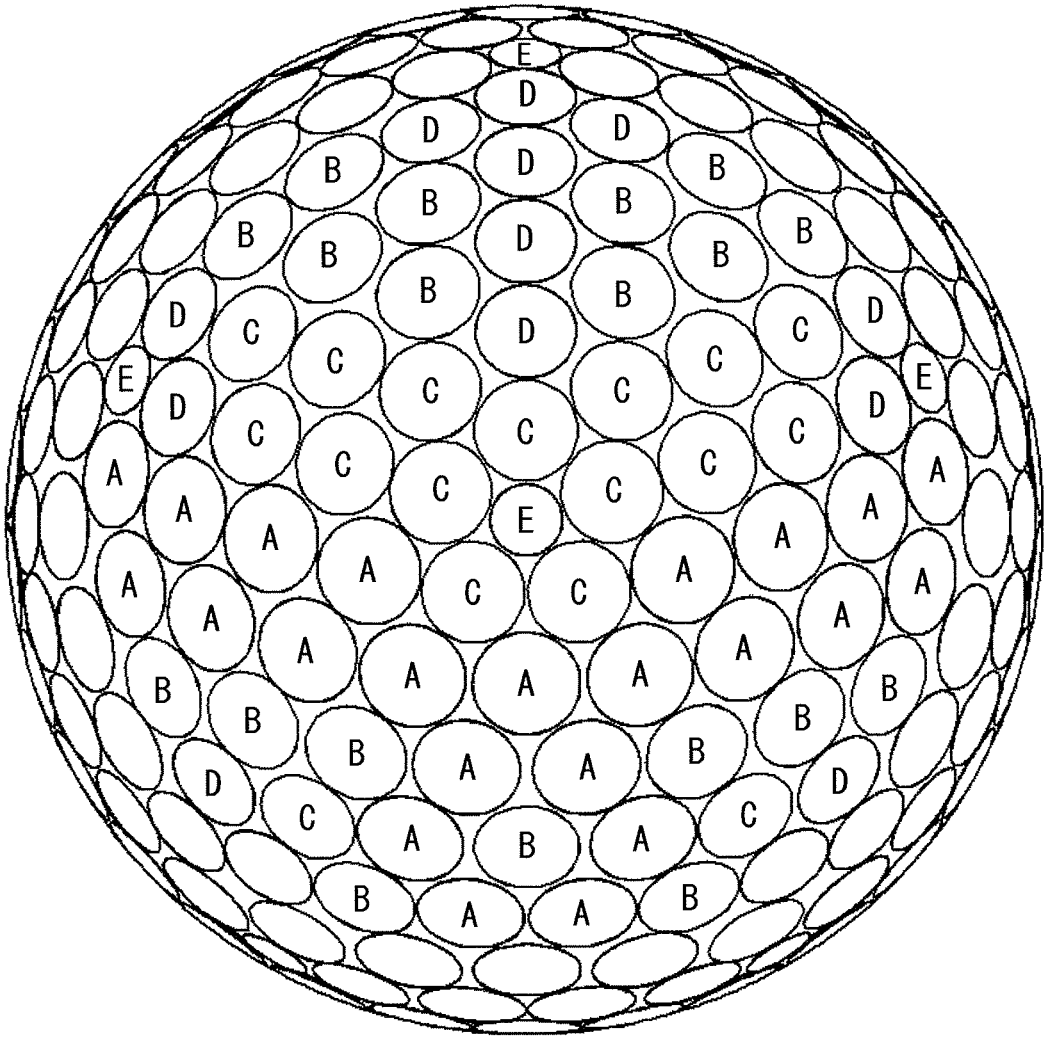
FIG. 4 is a plan view of the golf ball in FIG. 2.
Figure 5:
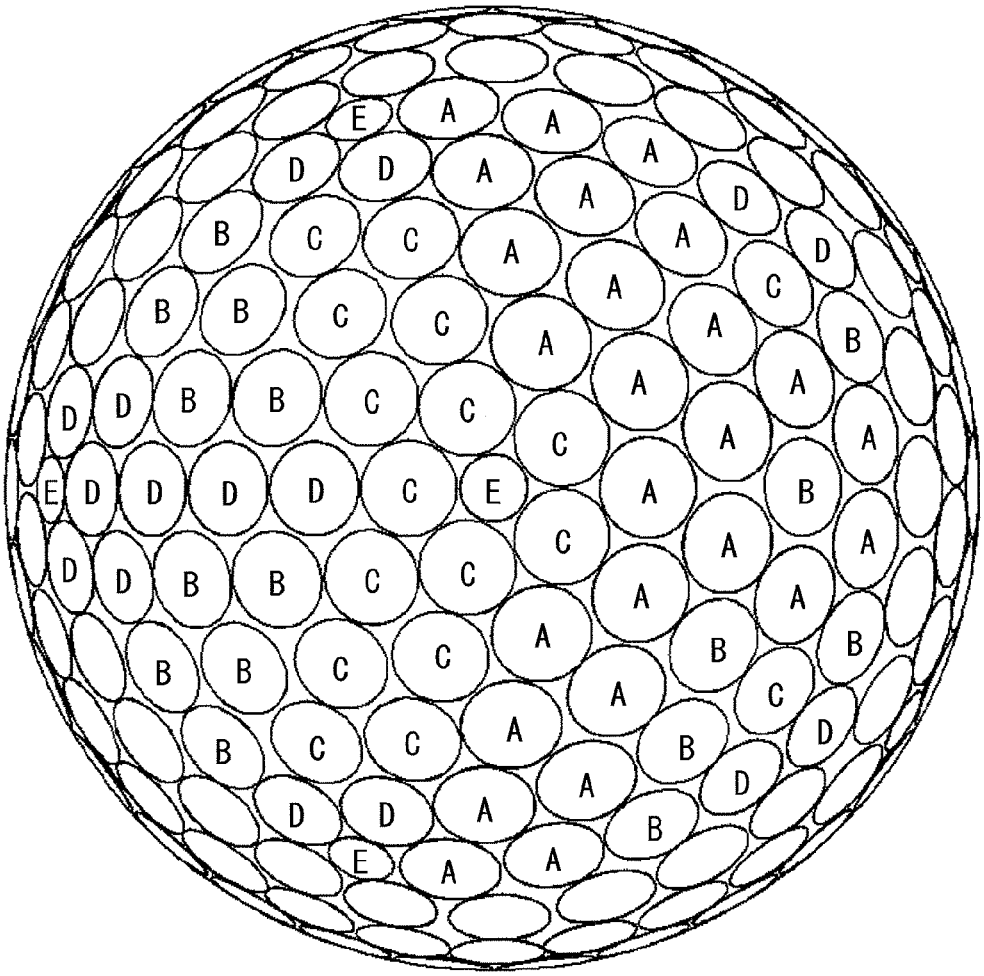
FIG. 5 is a bottom view of the golf ball in FIG. 2.
Figure 6:
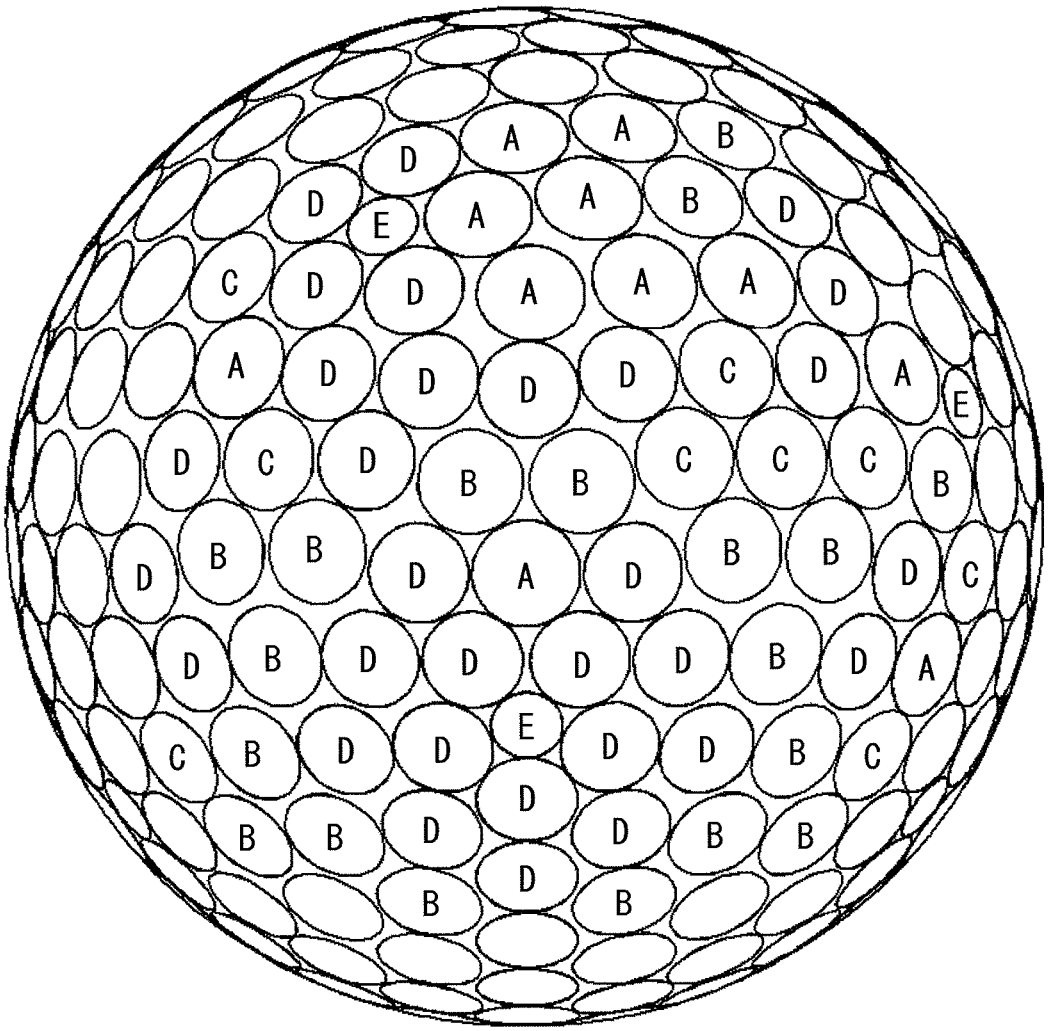
FIG. 6 is a left side view of the golf ball in FIG. 2.
Figure 7:
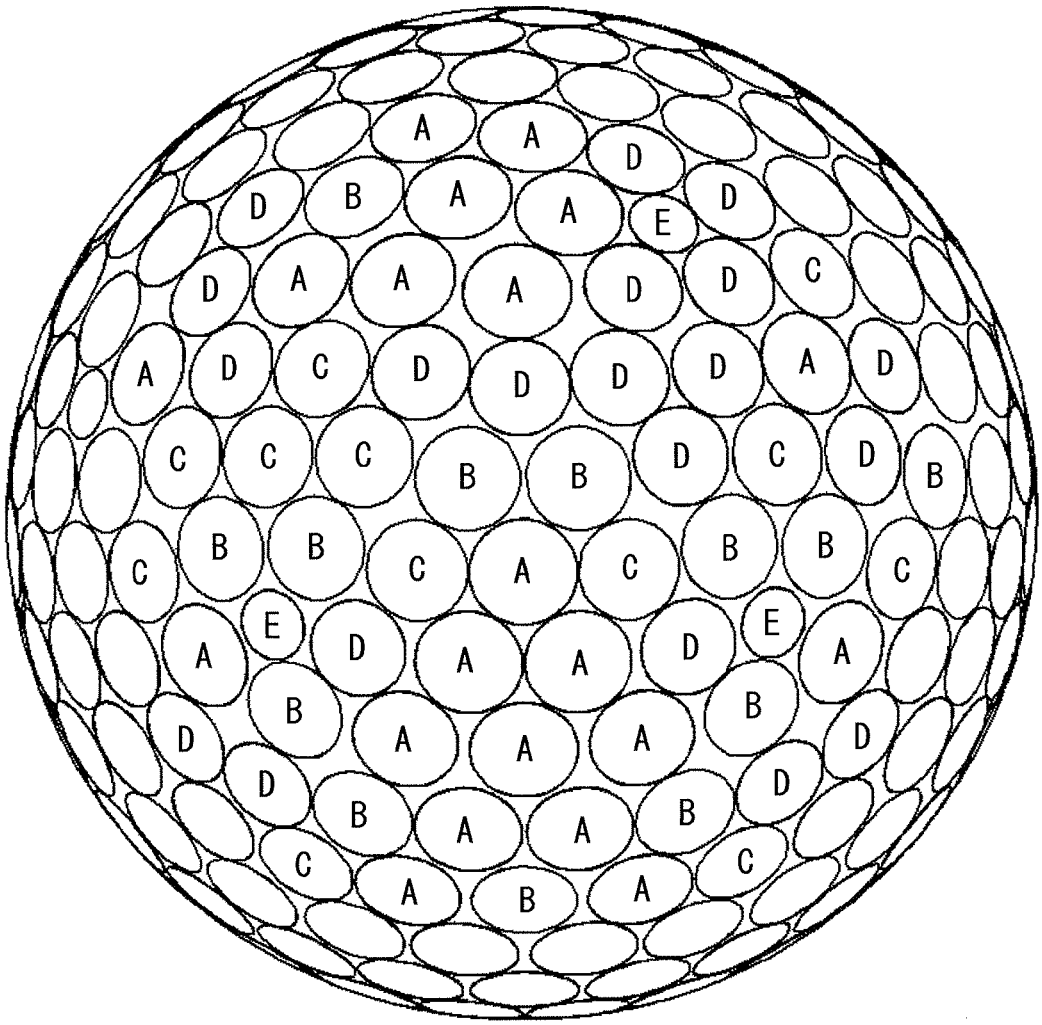
FIG. 7 is a right side view of the golf ball in FIG. 2.
Figure 9:
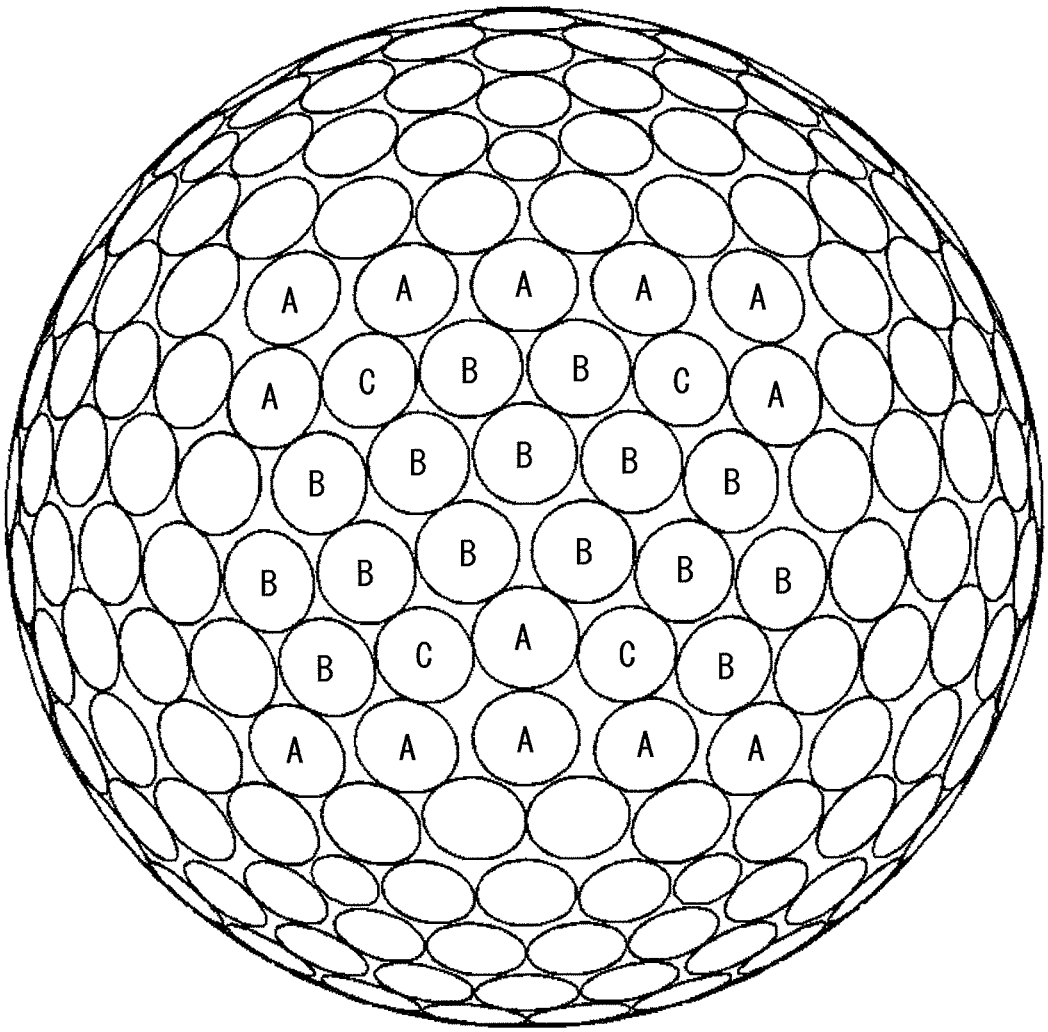
FIG. 9 is a front view of a golf ball according to Sample 3 of the present invention.
Figure 10:
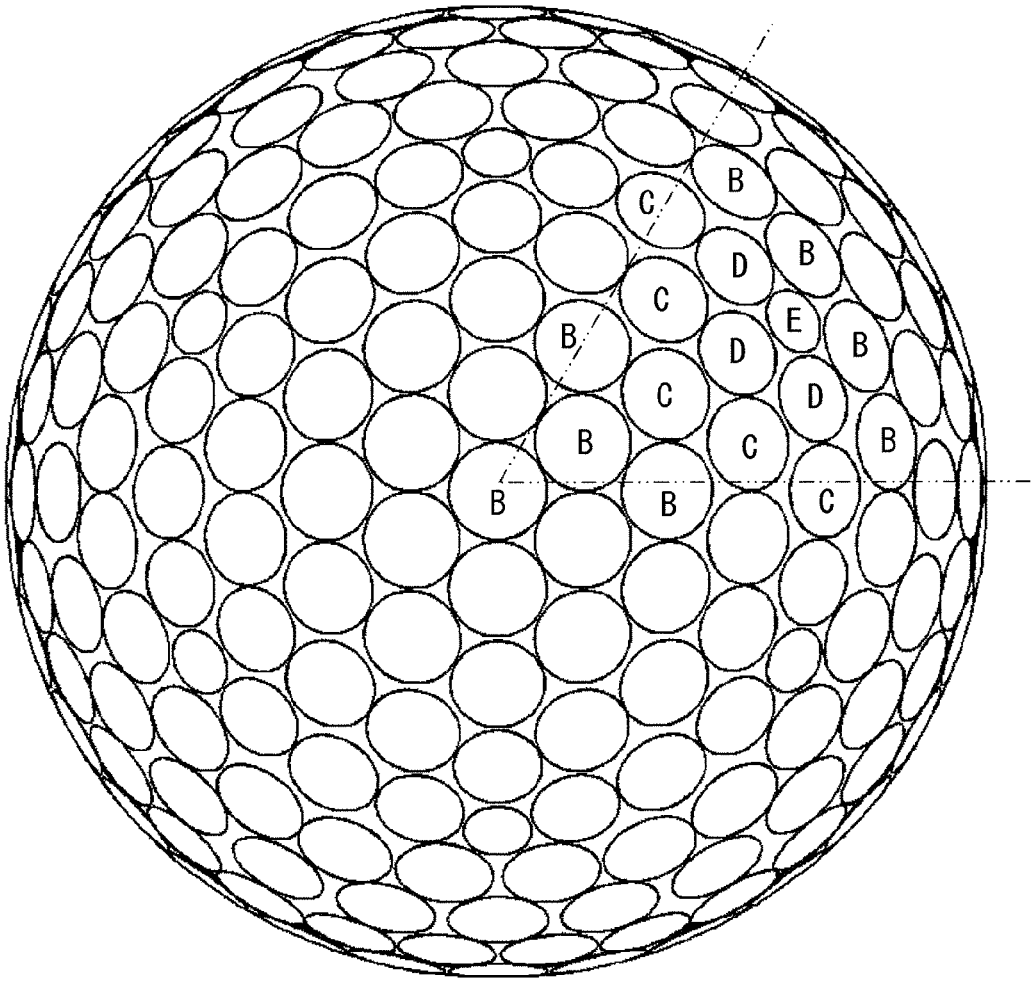
FIG. 10 is a plan view of the golf ball in FIG. 9.
Figure 11:
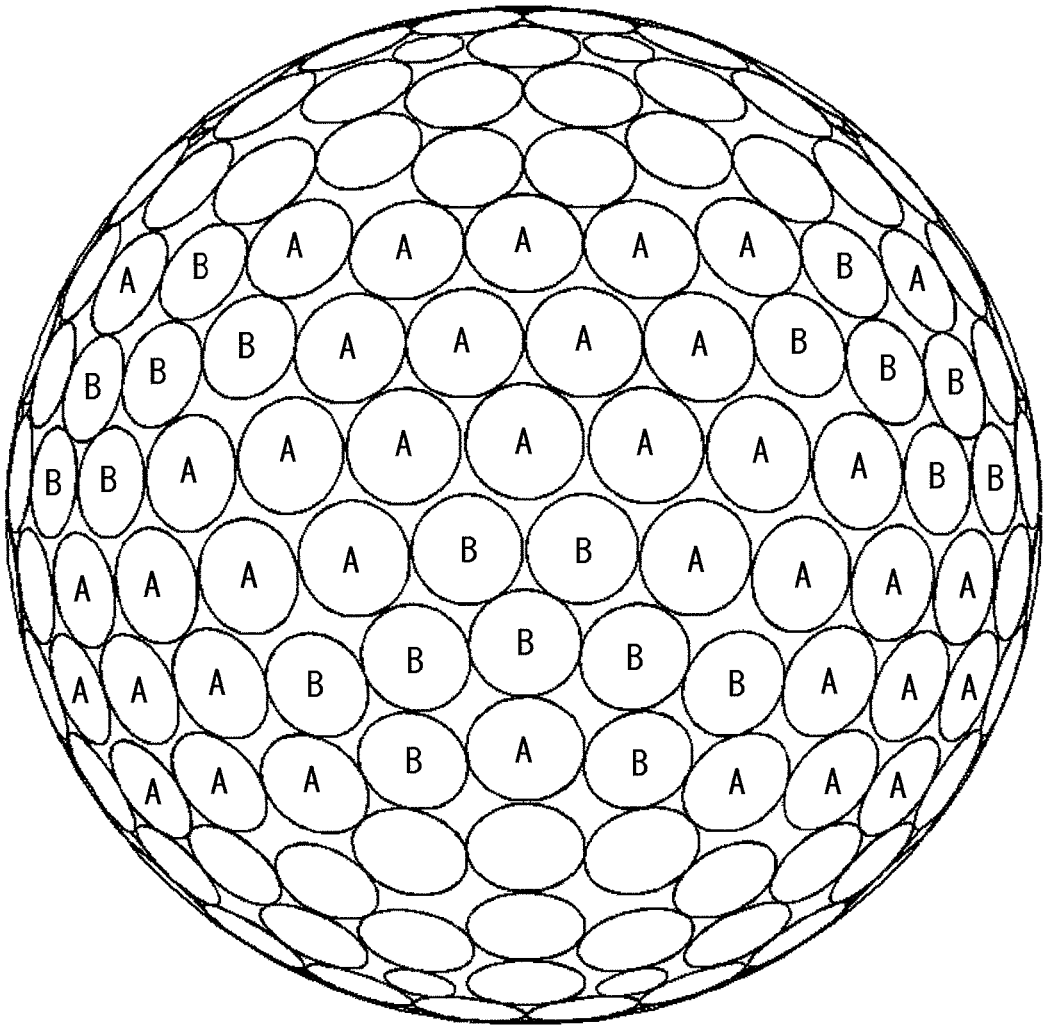
FIG. 11 is a front view of a golf ball according to Sample 4 of the present invention.
Figure 12:
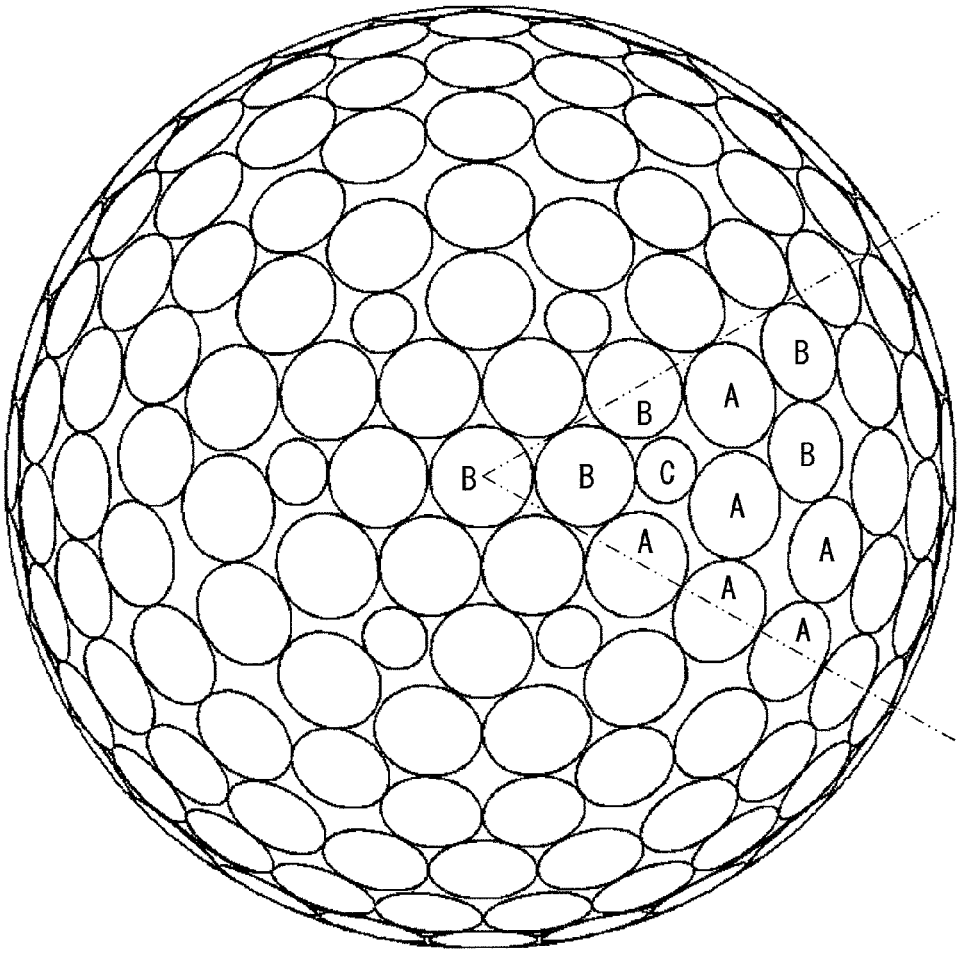
FIG. 12 is a plan view of the golf ball in FIG. 11.
Figure 13:
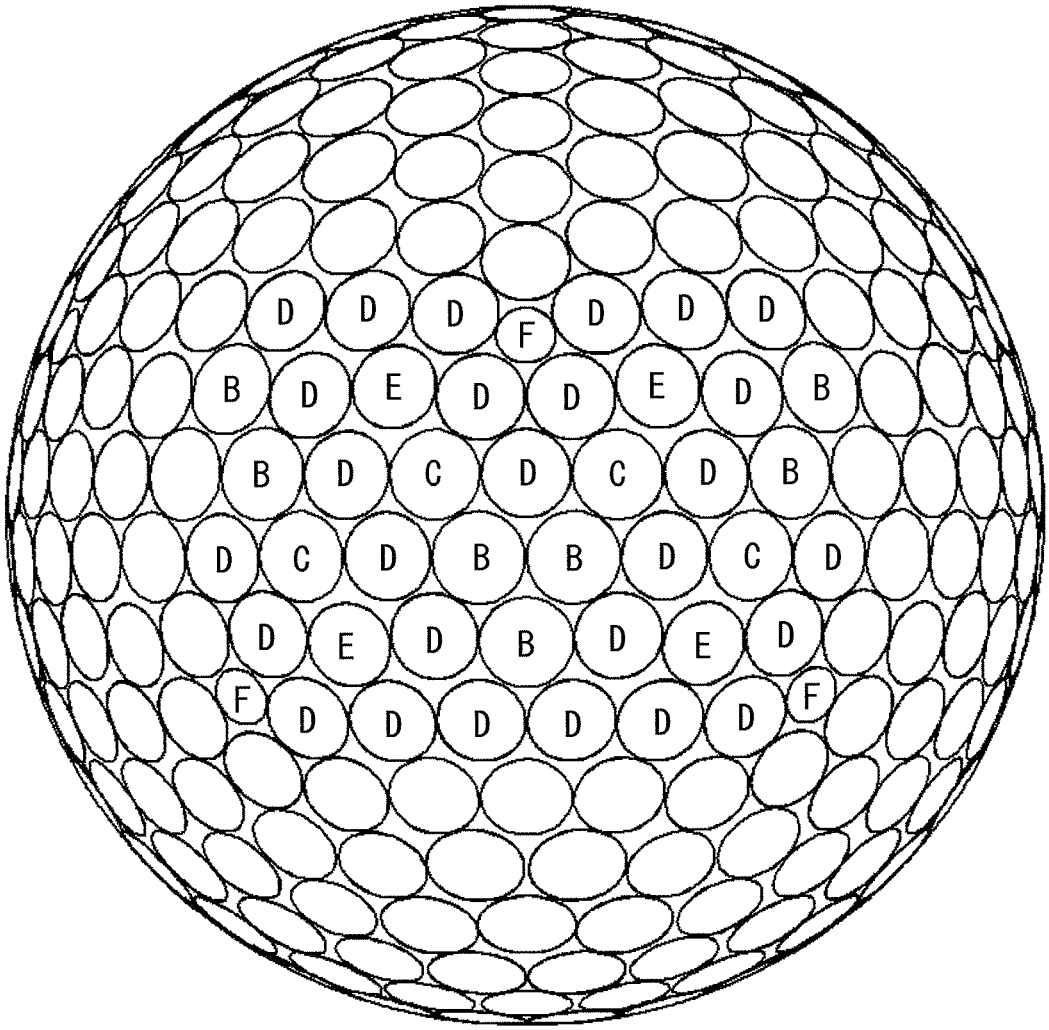
FIG. 13 is a front view of a golf ball according to Sample 5 of the present invention.
Figure 14:
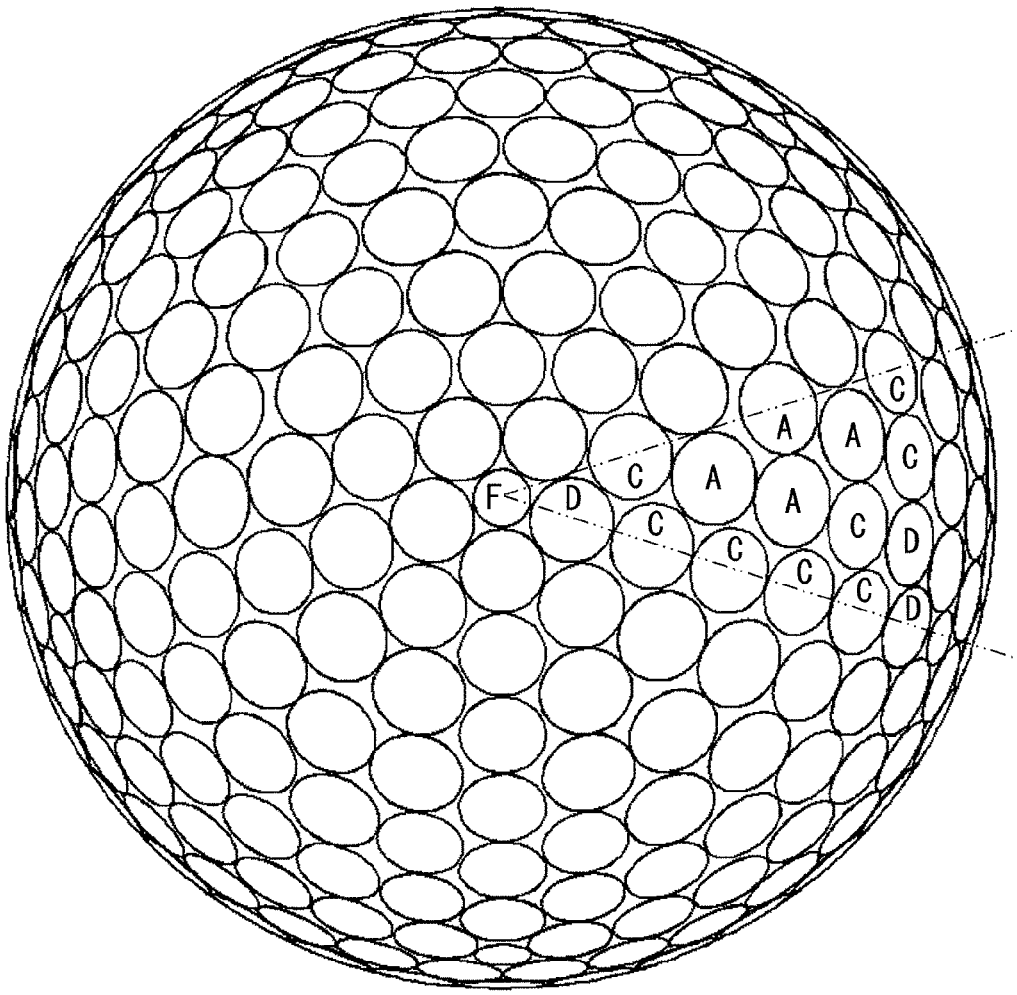
FIG. 14 is a plan view of the golf ball in FIG. 13.
Figure 15:
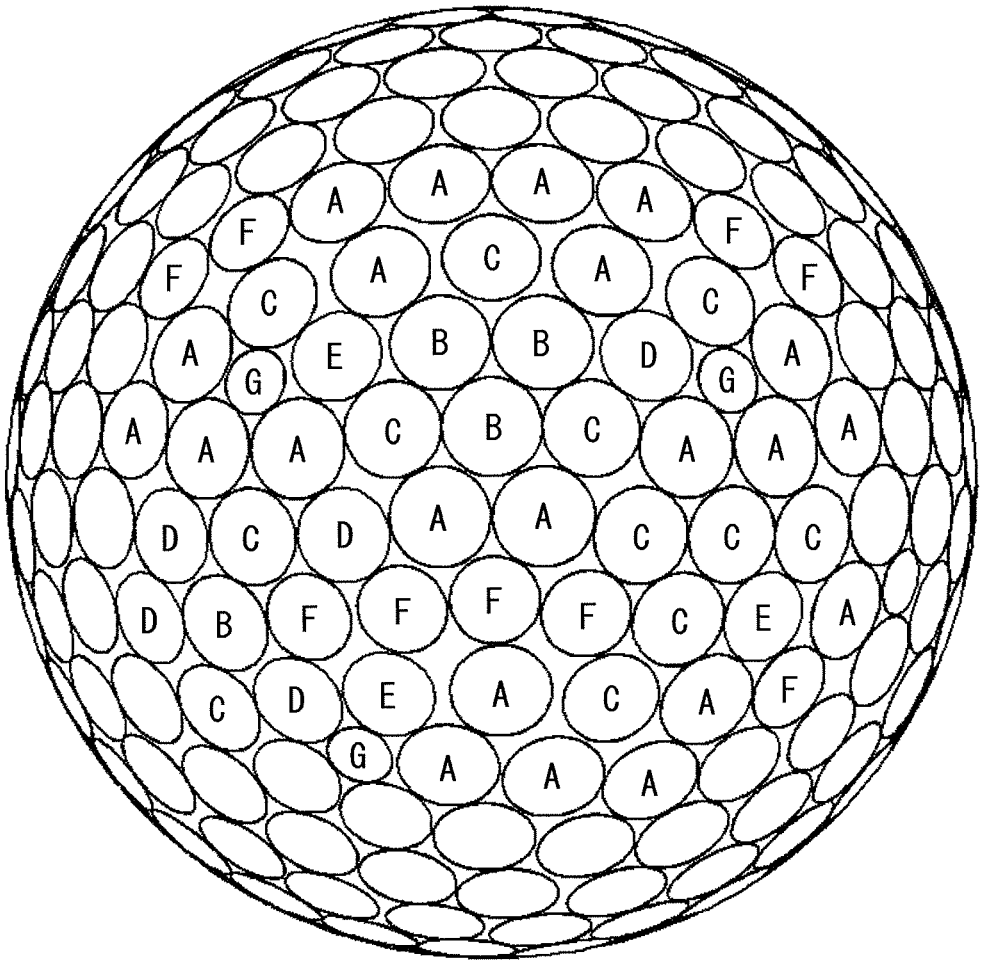
FIG. 15 is a front view of a golf ball according to Sample 1 of the present invention.
Figure 16:
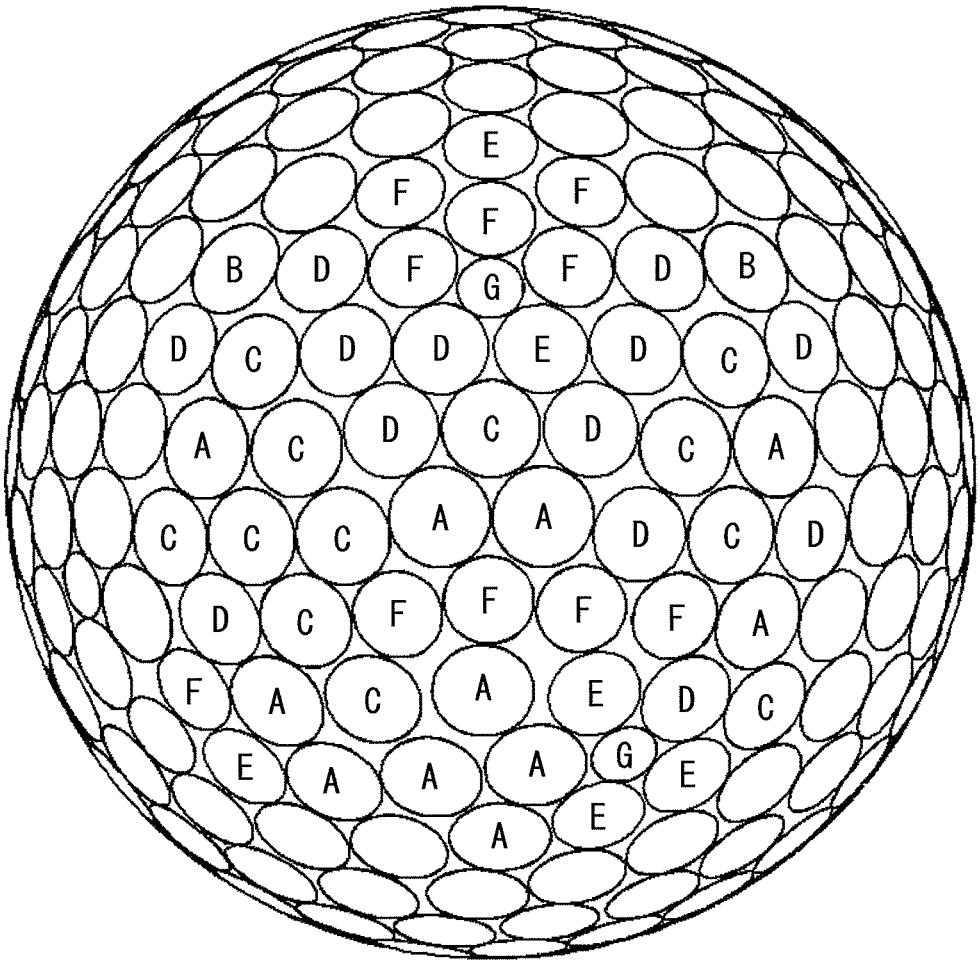
FIG. 16 is a back view of the golf ball in FIG. 15.
Figure 17:
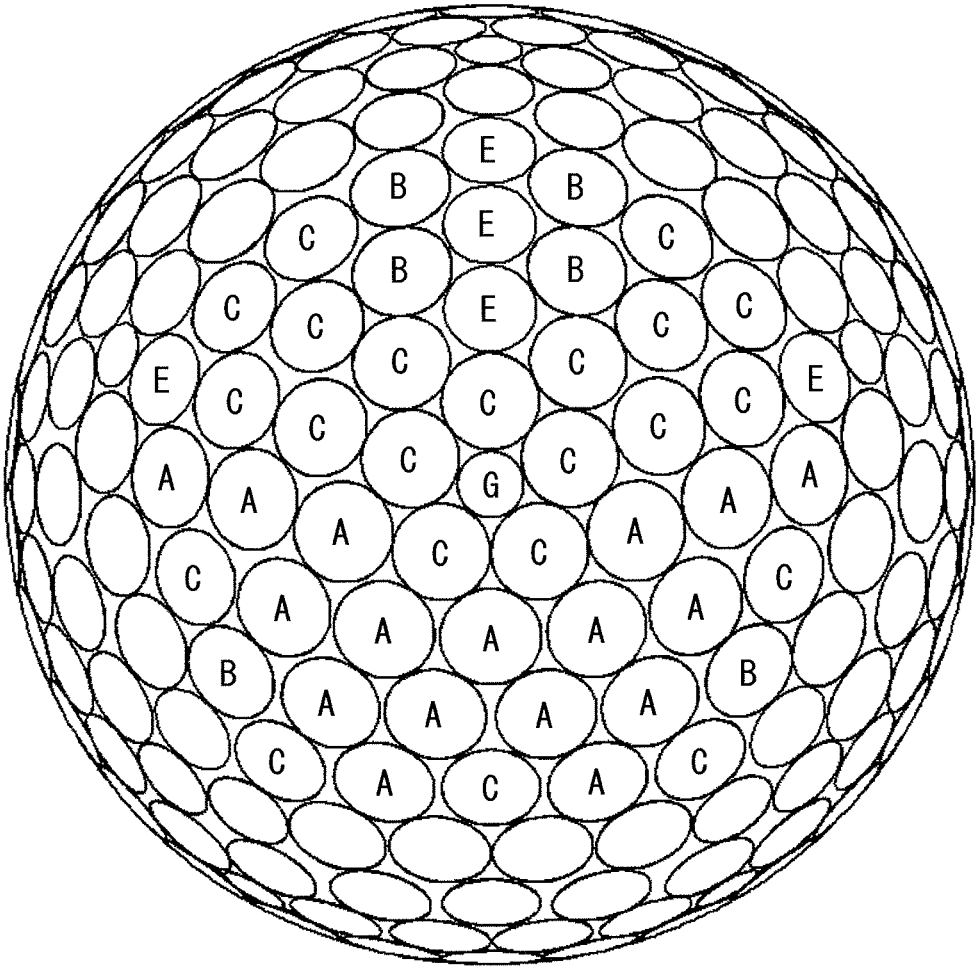
FIG. 17 is a plan view of the golf ball in FIG. 15.
Figure 18:
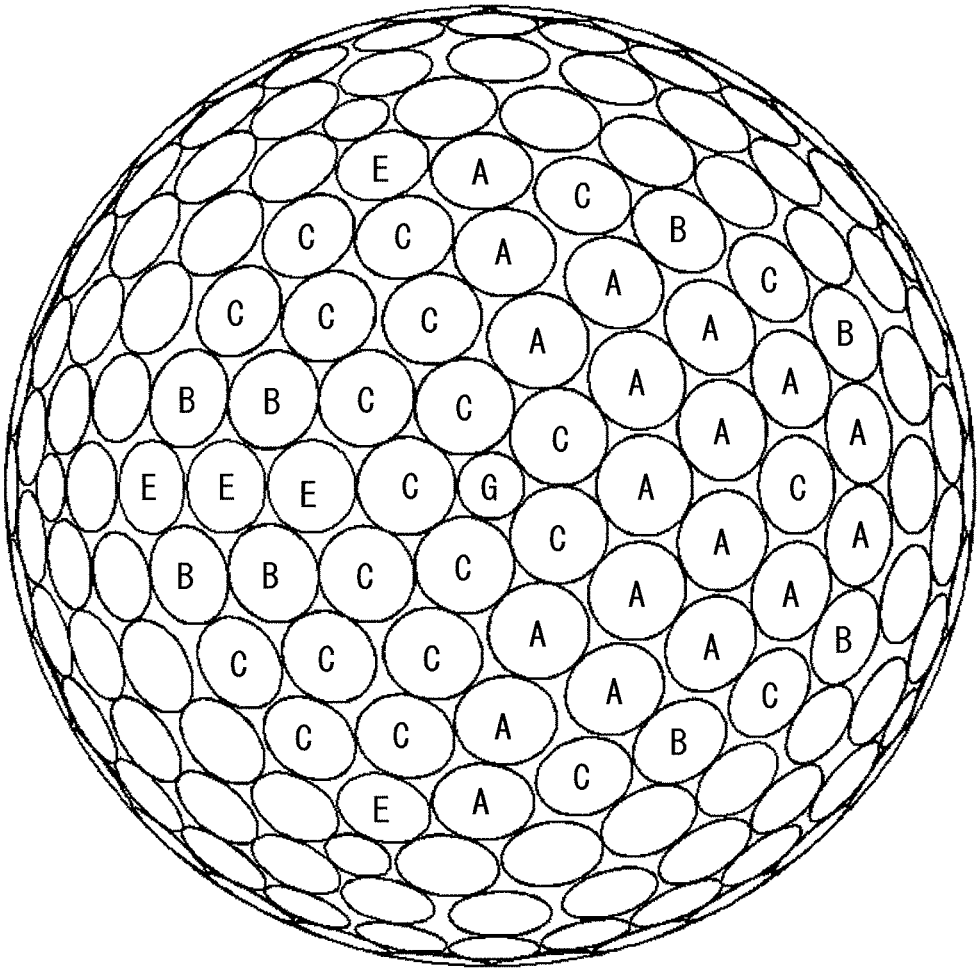
FIG. 18 is a bottom view of the golf ball in FIG. 15.
Figure 19:
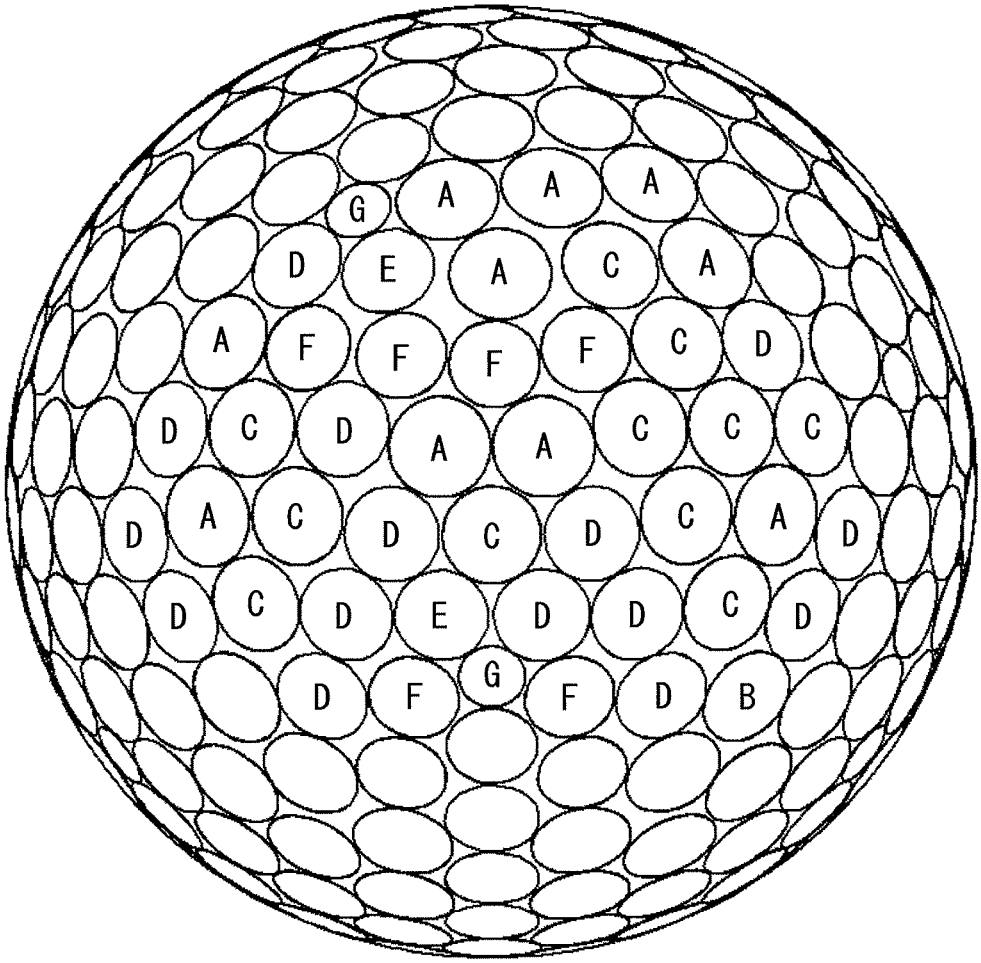
FIG. 19 is a left side view of the golf ball in FIG. 15.
Figure 20:
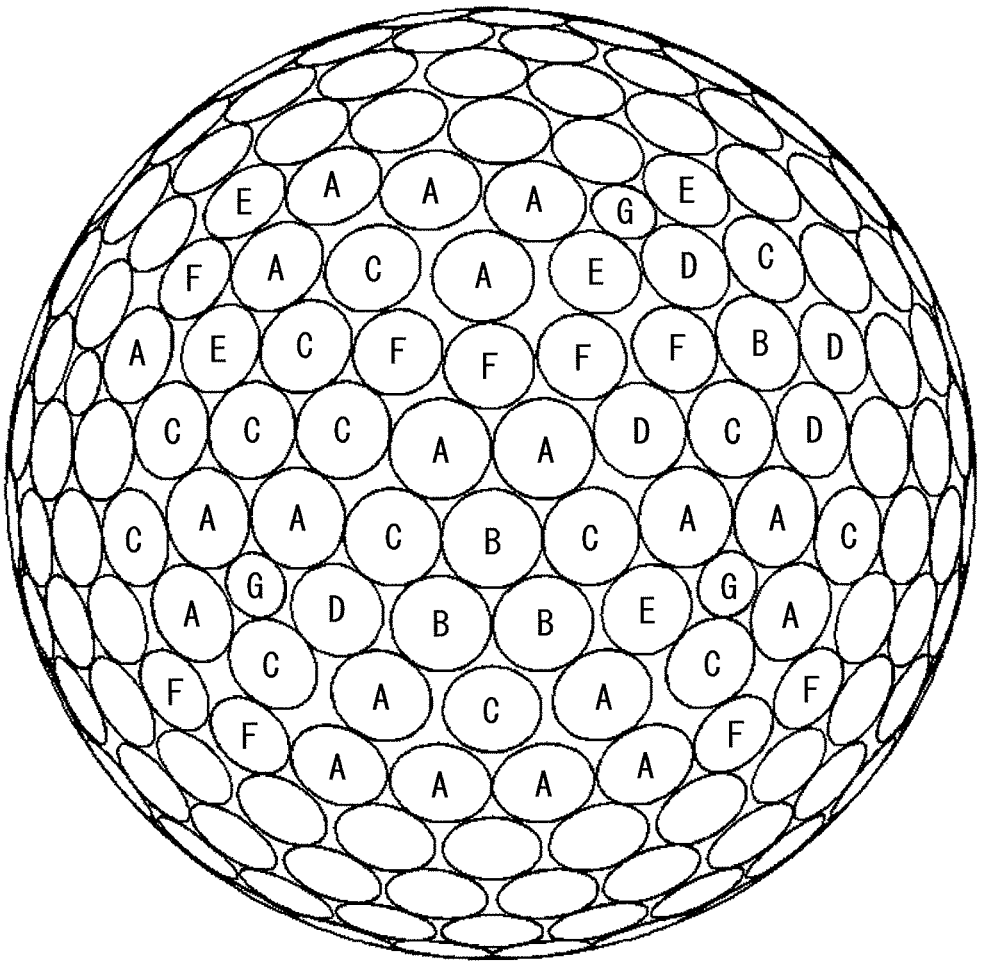
FIG. 20 is a right side view of the golf ball in FIG. 15.

| Results of Evaluation | | | | | |
|---|---|---|---|---|---|
| | Sample 1 | Sample 2 | Sample 3 | Sample 4 | Sample 5 |
| Front view | FIG. 15 | FIG. 2 | FIG. 9 | FIG. 11 | FIG. 13 |
| Plan view | FIG. 17 | FIG. 4 | FIG. 10 | FIG. 12 | FIG. 14 |
| Number | 324 | 324 | 338 | 266 | 422 |
| Occupation ratio (%) | 83.9 | 82.3 | 82.0 | 82.1 | 82.6 |
| Total volume ($mm^3$) | 592.9 | 575.8 | 562.3 | 632.2 | 519.8 |
| NS | 12 | 12 | 12 | 12 | 12 |
| NL | 312 | 312 | 326 | 254 | 410 |
| PS (%) | 1.5 | 1.5 | 1.5 | 1.5 | 1.0 |
| PL (%) | 82.4 | 80.8 | 80.5 | 80.6 | 81.6 |
| G | 1.07 | 0.80 | 0.95 | 0.95 | 0.91 |
| Flight distance | 261.8 | 262.1 | 263.0 | 261.2 | 261.0 |

TABLE I.7

Figure 21:
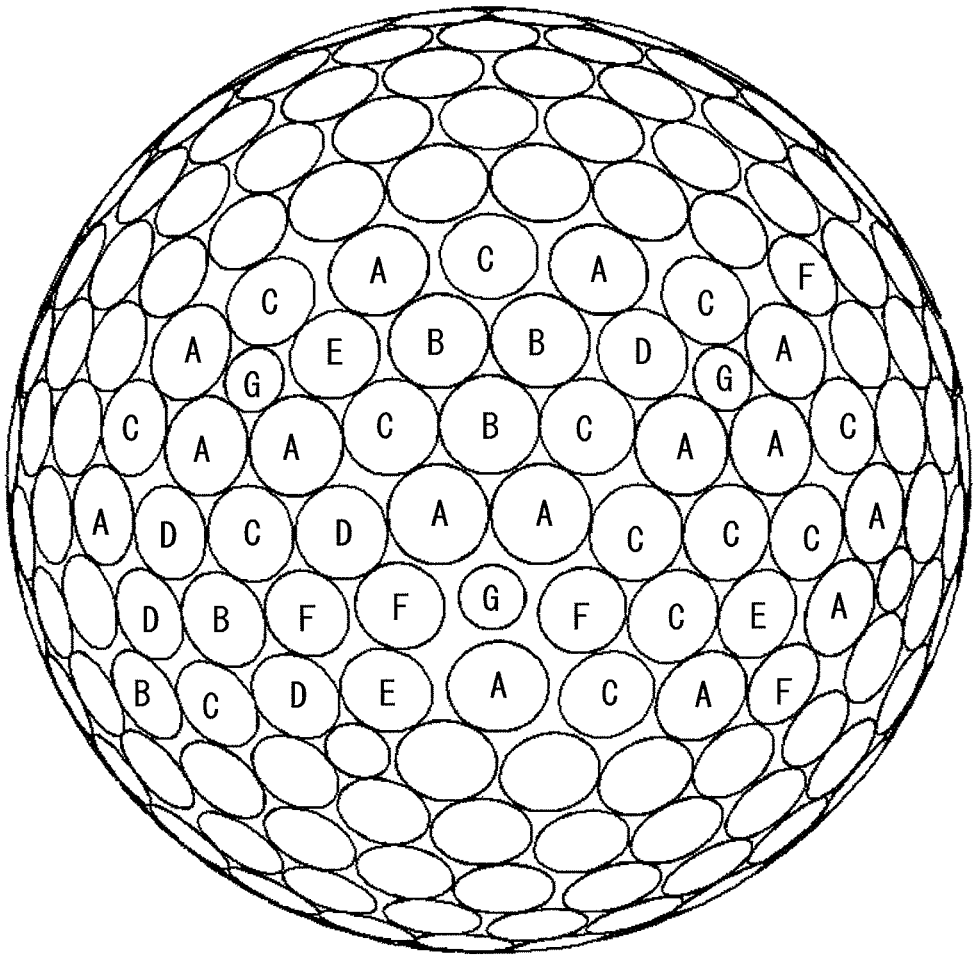
FIG. 21 is a front view of a golf ball according to Sample 6 of the present invention.
Figure 22:
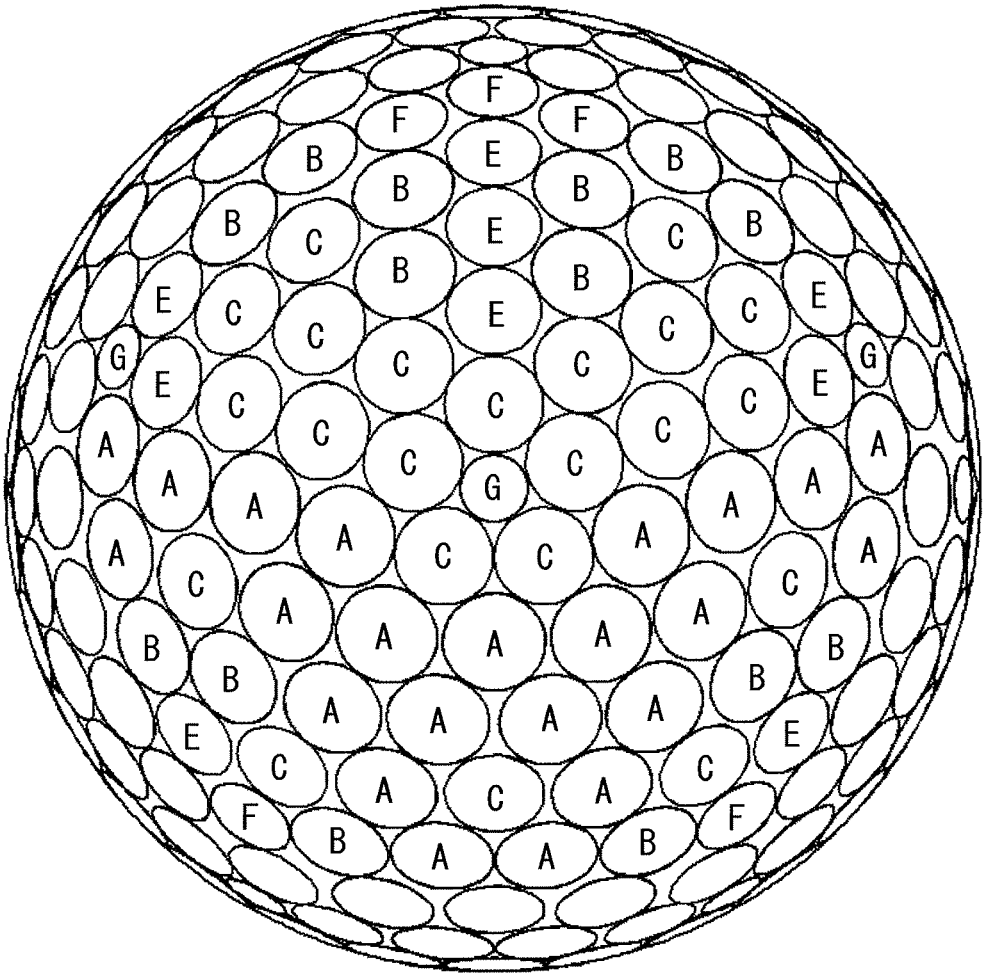
FIG. 22 is a plan view of the golf ball in FIG. 21.
Figure 23:
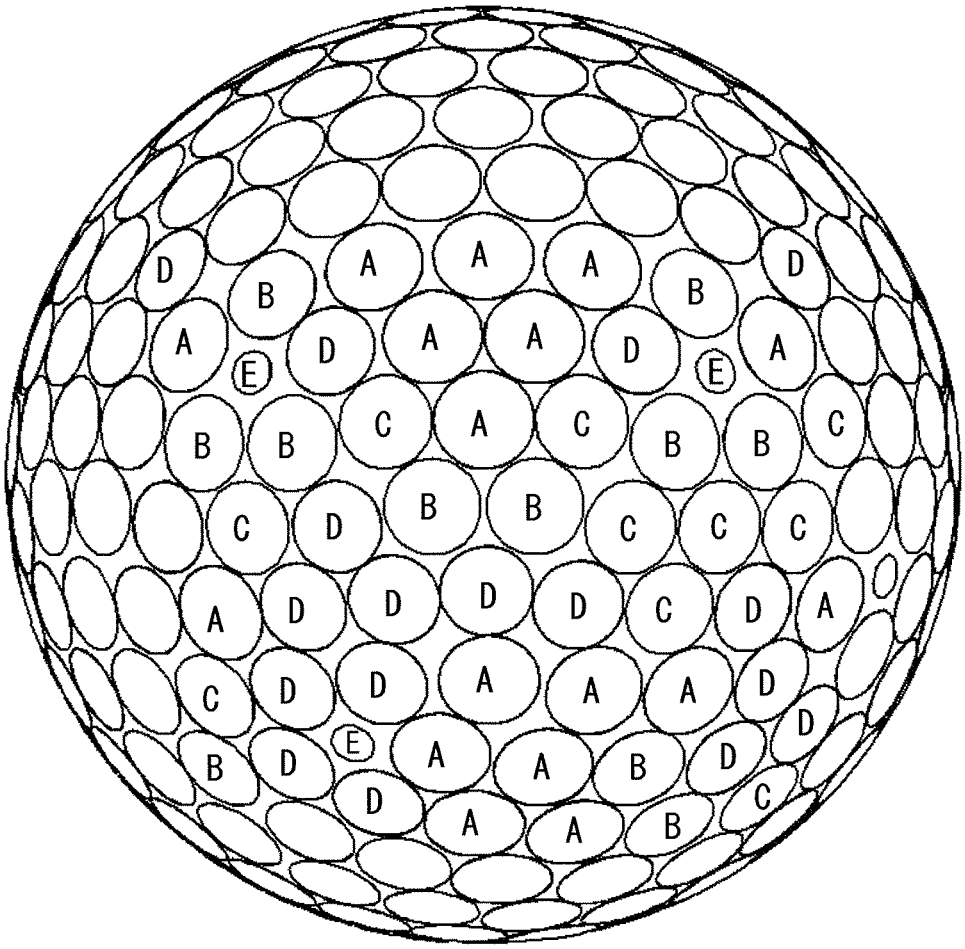
FIG. 23 is a front view of a golf ball according to Sample 7 of the present invention.
Figure 24:
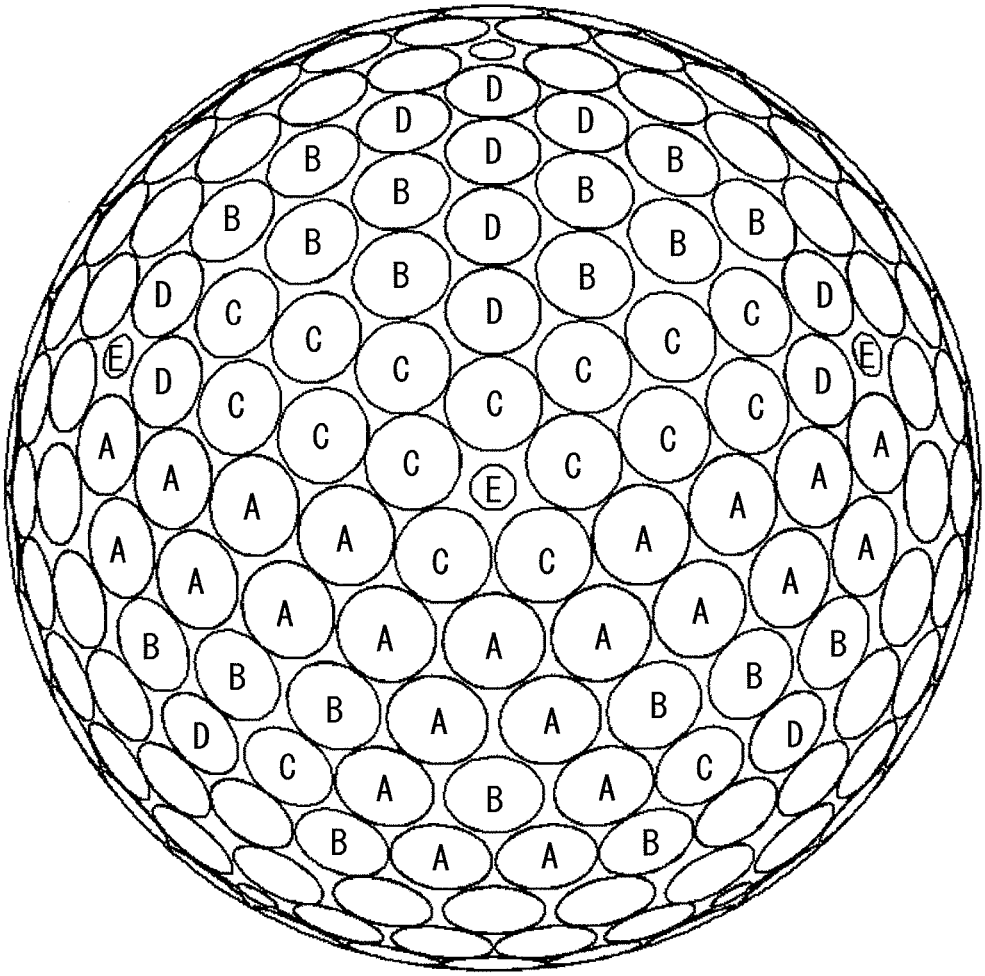
FIG. 24 is a plan view of the golf ball in FIG. 23.

| Results of Evaluation | | | | | |
|---|---|---|---|---|---|
| | Sample 6 | Sample 7 | Sample 8 | Sample 9 | Sample 10 |
| Front view | FIG. 21 | FIG. 23 | — | — | — |
| Plan view | FIG. 22 | FIG. 24 | — | — | — |
| Number | 324 | 324 | 333 | 270 | 344 |
| Occupation ratio (%) | 83.8 | 81.5 | 69.6 | 78.8 | 85.3 |
| Total volume ($mm^3$) | 592.0 | 570.9 | 492.1 | 599.0 | 590.1 |
| NS | 14 | 12 | 15 | 12 | 0 |
| NL | 310 | 312 | 318 | 258 | 344 |
| PS (%) | 1.8 | 0.7 | 1.2 | 1.6 | 0.0 |
| PL (%) | 81.9 | 80.8 | 68.4 | 77.2 | 85.3 |
| G | 1.06 | 0.80 | 1.39 | 2.34 | 1.42 |
| Flight distance | 261.5 | 261.3 | 257.3 | 256.5 | 260.6 |

TABLE I.8

Figure 25:
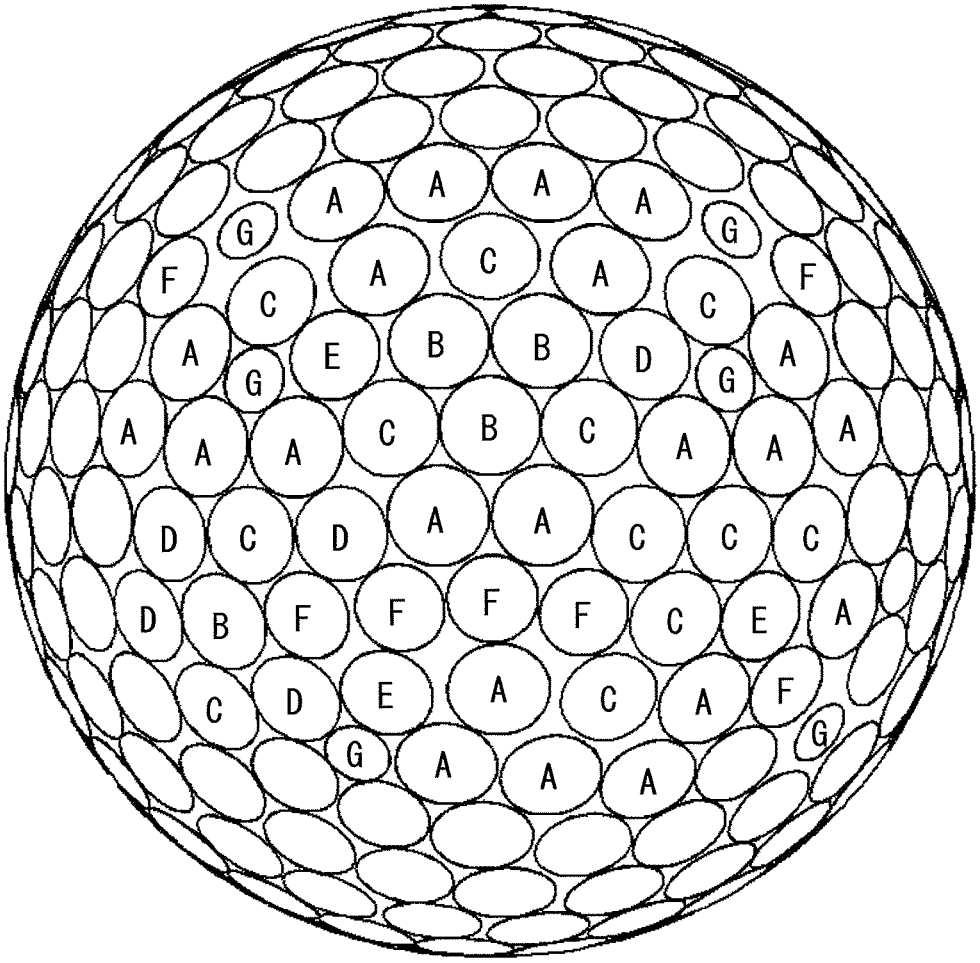
FIG. 25 is a front view of a golf ball according to Sample 14.
Figure 26:
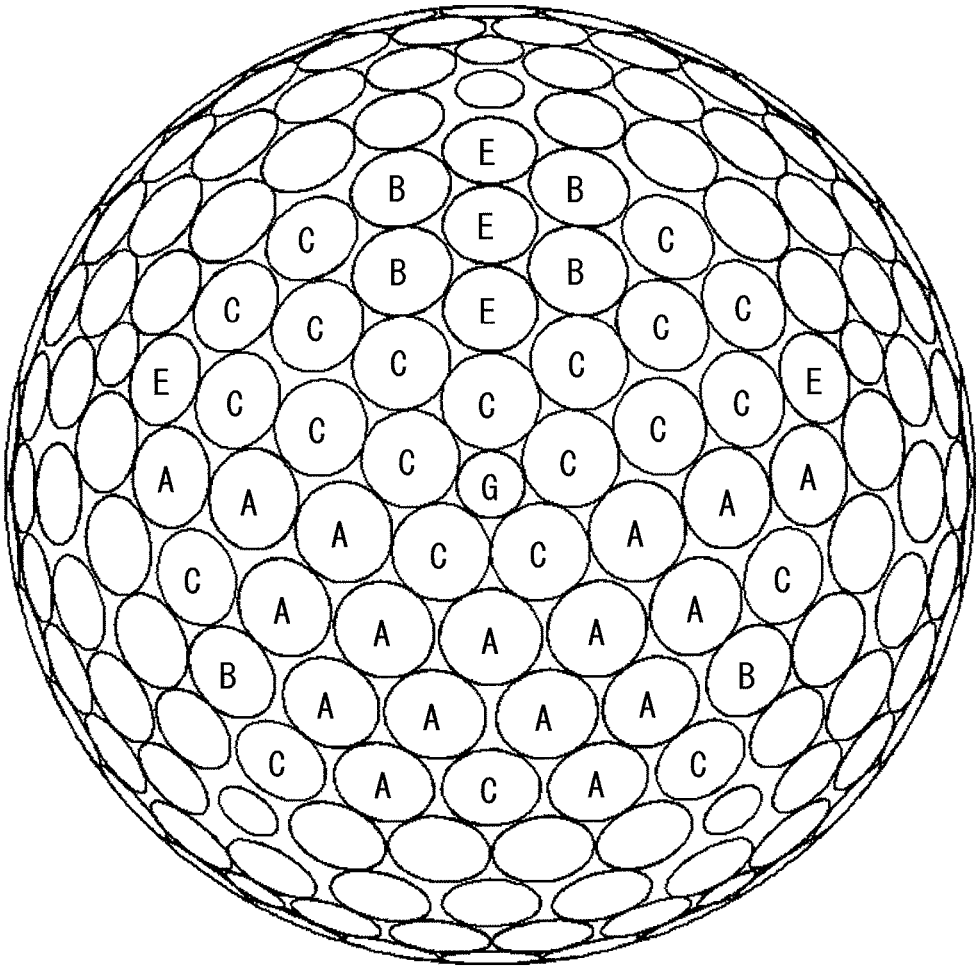
FIG. 26 is a plan view of the golf ball in FIG. 25.
Figure 27:
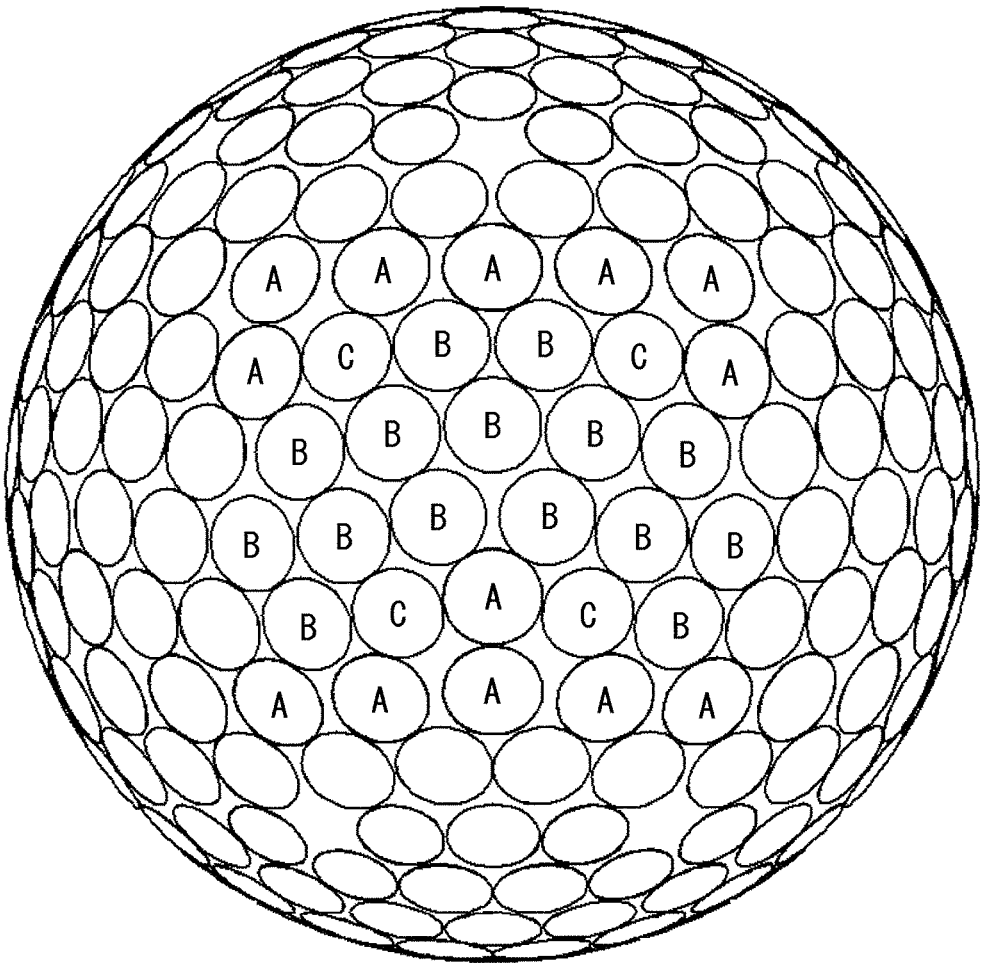
FIG. 27 is a front view of a golf ball according to Sample 15.
Figure 28:
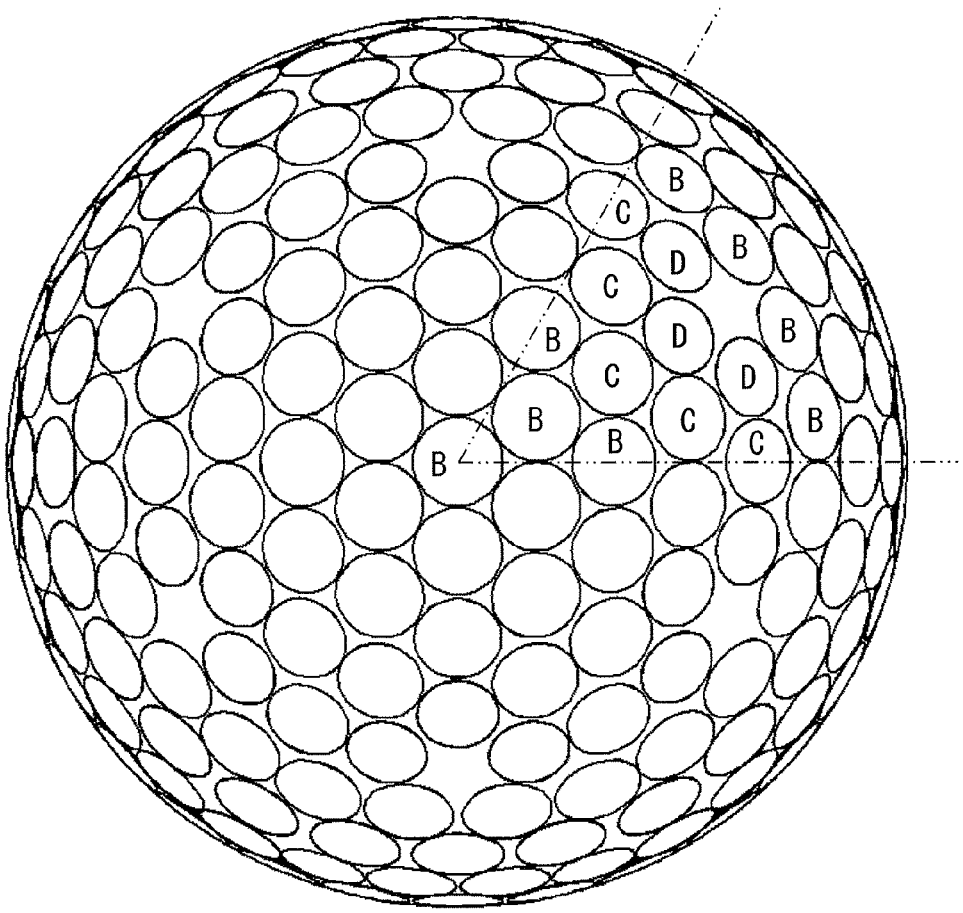
FIG. 28 is a plan view of the golf ball in FIG. 27.

| Results of Evaluation | | | | | |
|---|---|---|---|---|---|
| | Sample 11 | Sample 12 | Sample 13 | Sample 14 | Sample 15 |
| Front view | — | — | — | FIG. 25 | FIG. 27 |
| Plan view | — | — | — | FIG. 26 | FIG. 28 |
| Number | 372 | 372 | 432 | 324 | 326 |
| Occupation ratio (%) | 78.5 | 84.6 | 79.7 | 83.3 | 80.5 |

TABLE I.8-continued

| Results of Evaluation | | | | | |
|---|---|---|---|---|---|
| | Sample 11 | Sample 12 | Sample 13 | Sample 14 | Sample 15 |
| Total volume ($mm^3$) | 519.3 | 552.4 | 492.9 | 587.9 | 554.3 |
| NS | 18 | 18 | 0 | 18 | 0 |
| NL | 354 | 354 | 432 | 306 | 326 |
| PS (%) | 1.4 | 1.6 | 0.0 | 2.2 | 0.0 |
| PL (%) | 77.1 | 83.0 | 79.7 | 81.0 | 80.5 |
| G | 1.75 | 1.82 | 1.83 | 1.04 | 0.95 |
| Flight distance | 258.1 | 257.6 | 257.0 | 260.3 | 259.1 |

As shown in Tables I.6 to I.8, each of the golf balls according to Samples 1 to 7 has excellent flight performance. From the results of evaluation, advantages of the present invention are clear.

[Experiment II]

[Sample 16]

A rubber composition was obtained by kneading 100 parts by weight of a high-cis polybutadiene (trade name "BR-730" manufactured by JSR Corporation), 27 parts by weight of zinc diacrylate, 10 parts by weight of zinc stearate, 5 parts by weight of zinc oxide, an adequate amount of barium sulfate, 0.2 parts by weight of 2-thionaphthol, and 0.75 parts by weight of dicumyl peroxide. This rubber composition was placed into a mold including upper and lower mold halves each having a hemispherical cavity, and heated at 170° C. for 18 minutes to obtain a core with a diameter of 37.5 mm. An amount of compressive deformation CD of the core which was measured under the conditions of: an initial load of 98 N; and a final load of 1274 N, was 3.9 mm.

A resin composition J3 was obtained by kneading 43 parts by weight of an ionomer resin (the aforementioned trade name "Himilan AM7337"), 40 parts by weight of another ionomer resin (the aforementioned trade name "Himilan AM7329"), 17 parts by weight of a styrene block-containing thermoplastic elastomer (the aforementioned trade name "Rabalon T3221C"), and 6 parts by weight of titanium dioxide with a twin-screw kneading extruder. The core was covered with the resin composition J3 by injection molding to form a mid layer with a thickness of 1.6 mm.

A resin composition J2 was obtained by kneading 25 parts by weight of an ionomer resin (the aforementioned trade name "Himilan AM7337"), 50 parts by weight of another ionomer resin (the aforementioned trade name "Himilan AM7329"), 25 parts by weight of an ethylene-methacrylic acid copolymer (trade name "NUCREL N1050H" manufactured by Du Pont-MITSUI POLYCHEMICALS Co., Ltd), 3 parts by weight of titanium dioxide and 0.2 parts by weight of a light stabilizer (trade name "TINUVIN 770") with a twin-screw kneading extruder. The sphere consisting of the core and the mid layer was placed into a final mold having a large number of pimples on its cavity face. The mid layer was covered with the resin composition J2 by injection molding to form a cover with a thickness of 1.0 mm. Dimples having a shape that is the inverted shape of the pimples were formed on the cover.

A clear paint including a two-component curing type polyurethane as the base material was applied to this cover to obtain a golf ball of Sample 16 with a diameter of approximately 42.7 mm and a weight of approximately 45.6 g. A dimple type D1 of the golf ball is shown in detail in the above Tables I.1 and I.6.

[Samples 17, 21 to 23 and 30]

Golf balls of Samples 17, 21 to 23 and 30 were obtained in the same manner as Sample 16, except the specifications of the core, the mid layer and the cover were as shown in Tables II.2 and II.3 below. The compositions of the mid layer and the cover are shown in detail in Table II.1 below. The composition of the core is the same as the composition of the core of Sample 16.

[Samples 24 to 29 and 31 to 38]

Golf balls of Samples 24 to 29 and Samples 31 to 38 were obtained in the same manner as Sample 16, except the specifications of the dimples were as shown in Tables II.3 to II.6 below. The specifications of the dimples are shown in detail in the above Tables I.1 to I.8. The dimple pattern of the golf ball according to Sample 31 is the same as that of the golf ball according to Comparative Example 2 of JP2005-137692. The dimple pattern of the golf ball according to Sample 32 is the same as that of the golf ball according to Comparative Example 4 of JP2006-20820. The dimple pattern of the golf ball according to Sample 33 is the same as that of the golf ball according to Example 1 of JP2013-153966. The dimple pattern of the golf ball according to Sample 34 is the same as that of the golf ball according to Example 4 of JP2005-137692. The dimple pattern of the golf ball according to Sample 35 is the same as that of the golf ball according to Example 2 of JP2005-137692. The dimple pattern of the golf ball according to Sample 36 is the same as that of the golf ball according to Comparative Example 3 of JP2005-137692.

[Sample 18]

A rubber composition was obtained by kneading 100 parts by weight of a high-cis polybutadiene (trade name "BR-730" manufactured by JSR Corporation), 27 parts by weight of zinc diacrylate, 10 parts by weight of zinc stearate, 5 parts by weight of zinc oxide, an adequate amount of barium sulfate, 0.2 parts by weight of 2-thionaphthol, and 0.75 parts by weight of dicumyl peroxide. This rubber composition was placed into a mold including upper and lower mold halves each having a hemispherical cavity, and heated at 170° C. for 18 minutes to obtain a core with a diameter of 36.7 mm. An amount of compressive deformation CD of the core was 3.9 mm.

A resin composition J5 was obtained by kneading 26 parts by weight of an ionomer resin (the aforementioned trade name "Himilan AM7337"), 40 parts by weight of another ionomer resin (the aforementioned trade name "Himilan AM7329"), 34 parts by weight of a styrene block-containing thermoplastic elastomer (the aforementioned trade name "Rabalon T3221C"), and 6 parts by weight of titanium dioxide with a twin-screw kneading extruder. The core was covered with the resin composition J5 by injection molding to form a first mid layer with a thickness of 0.8 mm.

A resin composition J4 was obtained by kneading 53 parts by weight of an ionomer resin (the aforementioned trade name "Himilan AM7337"), 27 parts by weight of another ionomer resin (the aforementioned trade name "Himilan AM7329"), 20 parts by weight of a styrene block-containing thermoplastic elastomer (the aforementioned trade name "Rabalon T3221C"), and 6 parts by weight of titanium dioxide with a twin-screw kneading extruder. The first mid layer was covered with the resin composition J4 by injection molding to form a second mid layer with a thickness of 1.0 mm.

A resin composition J1 was obtained by kneading 35 parts by weight of an ionomer resin (the aforementioned trade name "Himilan 1555"), 63 parts by weight of another ionomer resin (the aforementioned trade name "Himilan AM7329"), 2 parts by weight of a styrene block-containing thermoplastic elastomer (the aforementioned trade name "Rabalon T3221C"), 3 parts by weight of titanium dioxide and 0.2 parts by weight of a light stabilizer (the aforementioned trade name "TINUVIN 770") with a twin-screw kneading extruder. The sphere consisting of the core, the first mid layer and the second mid layer was placed into a final mold having a large number of pimples on its cavity face. The second mid layer was covered with the resin composition J1 by injection molding to form a cover with a thickness of 1.2 mm. Dimples having a shape that is the inverted shape of the pimples were formed on the cover.

A clear paint including a two-component curing type polyurethane as the base material was applied to this cover to obtain a golf ball of Sample 18 with a diameter of approximately 42.7 mm and a weight of approximately 45.6 g. A dimple type D1 of the golf ball is shown in detail in the above Tables I.1 and I.6.

[Samples 19 and 20]

Golf balls of Samples 19 and 20 were obtained in the same manner as Sample 18, except the specifications of the core, the first mid layer, the second mid layer and the cover were as shown in Table II.2 below. The compositions of the first mid layer, the second mid layer and the cover are shown in detail in Table II.1 below. The composition of the core is the same as the composition of the core of Sample 18.

[Flight Test]

A driver with a head made of a titanium alloy (trade name "XXIO", manufactured by DUNLOP SPORTS CO. LTD., shaft hardness: R, loft angle: 10.5°) was attached to a swing machine manufactured by True Temper Co. A golf ball was hit under the condition of a head speed of 40 m/sec, and the flight distance and the spin rate were measured. The flight distance is a distance from the hitting point to the point at which the ball stopped. The average value of data obtained by 10 measurements is shown in Tables II.2 to II.6 below.

[Feel at Impact]

Ten golf players hit golf balls with drivers, and were asked about feeling. The evaluation was categorized as follows based on the number of golf players who answered "the feeling was favorable".

A: 8 to 10

B: 5 to 7

C: 2 to 4

D: 0 to 1

The results are shown in Tables II.2 to II.6 below.

TABLE II.1

Compositions of Mid layer and Cover (parts by weight)

| | J1 | J2 | J3 | J4 | J5 |
|---|---|---|---|---|---|
| Himilan AM7337 | — | 25 | 43 | 53 | 26 |
| Himilan 1555 | 35 | — | — | — | — |
| Himilan AM7329 | 63 | 50 | 40 | 27 | 40 |
| NUCREL N1050H | — | 25 | — | — | — |
| Rabalon T3221C | 2 | — | 17 | 20 | 34 |
| Titanium dioxide (A220) | 3 | 3 | 6 | 6 | 6 |
| TINUVIN 770 | 0.2 | 0.2 | — | — | — |
| Slab hardness (Shore D) | 63 | 60 | 55 | 50 | 45 |

TABLE II.2

Results of Evaluation

| | Sample 30 | Sample 17 | Sample 18 | Sample 19 | Sample 20 |
|---|---|---|---|---|---|
| Core | | | | | |
| CD (mm) | 3.9 | 3.9 | 3.9 | 3.9 | 3.9 |
| Diameter (mm) | 37.1 | 36.3 | 36.7 | 36.7 | 36.7 |
| First mid layer | | | | | |
| Composition | — | — | J5 | J4 | J4 |
| Hardness (Shore D) | — | — | 45 | 50 | 50 |
| Thickness (mm) | — | — | 0.8 | 0.8 | 1.2 |
| (Second) mid layer | | | | | |
| Composition | J5 | J5 | J4 | J3 | J3 |
| Hardness (Shore D) | 45 | 45 | 50 | 55 | 55 |
| Thickness (mm) | 1.0 | 1.2 | 1.0 | 1.0 | 1.0 |
| Cover | | | | | |
| Composition | J3 | J4 | J1 | J2 | J2 |
| Hardness (Shore D) | 55 | 50 | 63 | 60 | 60 |
| Thickness (mm) | 1.8 | 2.0 | 1.2 | 1.2 | 0.8 |
| THm | 45 | 54 | 43 | 47.5 | 57.5 |
| THc | 99 | 100 | 75.6 | 72 | 48 |
| THc − THm | 54.0 | 46.0 | 32.6 | 24.5 | −9.5 |
| Dimple | D1 | D1 | D1 | D1 | D1 |
| PS (%) | 1.5 | 1.5 | 1.5 | 1.5 | 1.5 |
| PL (%) | 82.4 | 82.4 | 82.4 | 82.4 | 82.4 |
| G | 1.07 | 1.07 | 1.07 | 1.07 | 1.07 |
| Flight distance (m) | 197.0 | 197.7 | 198.0 | 198.3 | 198.2 |
| Spin (rpm) | 2500 | 2450 | 2430 | 2410 | 2415 |
| Feeling | A | A | A | A | A |

TABLE II.3

Results of Evaluation

| | Sample 16 | Sample 21 | Sample 22 | Sample 23 | Sample 24 |
|---|---|---|---|---|---|
| Core | | | | | |
| CD (mm) | 3.9 | 3.9 | 3.9 | 3.9 | 3.9 |
| Diameter (mm) | 37.5 | 36.7 | 36.7 | 35.1 | 37.5 |
| First mid layer | | | | | |
| Composition | — | — | — | — | — |
| Hardness (Shore D) | — | — | — | — | — |
| Thickness (mm) | — | — | — | — | — |
| (Second) mid layer | | | | | |
| Composition | J3 | J4 | J3 | J4 | J3 |
| Hardness (Shore D) | 55 | 50 | 55 | 50 | 55 |
| Thickness (mm) | 1.6 | 2.0 | 2.0 | 2.6 | 1.6 |
| Cover | | | | | |
| Composition | J2 | J1 | J1 | J2 | J2 |
| Hardness (Shore D) | 60 | 63 | 63 | 63 | 60 |
| Thickness (mm) | 1.0 | 1.0 | 1.0 | 1.2 | 1.0 |
| THm | 88 | 100 | 110 | 130 | 88 |
| THc | 60 | 63 | 63 | 75.6 | 60 |
| THc − THm | −28.0 | −37.0 | −47.0 | −54.4 | −28.0 |
| Dimple | D1 | D1 | D1 | D1 | D2 |
| PS (%) | 1.5 | 1.5 | 1.5 | 1.5 | 1.5 |
| PL (%) | 82.4 | 82.4 | 82.4 | 82.4 | 80.8 |
| G | 1.07 | 1.07 | 1.07 | 1.07 | 0.80 |
| Flight distance (m) | 198.1 | 198.3 | 198.5 | 198.7 | 198.4 |
| Spin (rpm) | 2420 | 2405 | 2395 | 2380 | 2420 |
| Feeling | A | B | C | D | A |

TABLE II.4

| Results of Evaluation | Sample 25 | Sample 26 | Sample 27 | Sample 28 | Sample 29 |
|---|---|---|---|---|---|
| Core | | | | | |
| CD (mm) | 3.9 | 3.9 | 3.9 | 3.9 | 3.9 |
| Diameter (mm) | 37.5 | 37.5 | 37.5 | 37.5 | 37.5 |
| First mid layer | | | | | |
| Composition | — | — | — | — | — |
| Hardness (Shore D) | — | — | — | — | — |
| Thickness (mm) | — | — | — | — | — |
| (Second) mid layer | | | | | |
| Composition | J3 | J3 | J3 | J3 | J3 |
| Hardness (Shore D) | 55 | 55 | 55 | 55 | 55 |
| Thickness (mm) | 1.6 | 1.6 | 1.6 | 1.6 | 1.6 |
| Cover | | | | | |
| Composition | J2 | J2 | J2 | J2 | J2 |
| Hardness (Shore D) | 60 | 60 | 60 | 60 | 60 |
| Thickness (mm) | 1.0 | 1.0 | 1.0 | 1.0 | 1.0 |
| THm | 88 | 88 | 88 | 88 | 88 |
| THc | 60 | 60 | 60 | 60 | 60 |
| THc − THm | −28.0 | −28.0 | −28.0 | −28.0 | −28.0 |
| Dimple | D3 | D4 | D5 | D6 | D7 |
| PS (%) | 1.5 | 1.5 | 1.0 | 1.8 | 0.7 |
| PL (%) | 80.5 | 80.6 | 81.6 | 81.9 | 80.8 |
| G | 0.95 | 0.95 | 0.91 | 1.06 | 0.80 |
| Flight distance (m) | 199.1 | 197.7 | 197.5 | 197.9 | 197.7 |
| Spin (rpm) | 2420 | 2420 | 2420 | 2420 | 2420 |
| Feeling | A | A | A | A | A |

TABLE II.5

| Results of Evaluation | Sample 31 | Sample 32 | Sample 33 | Sample 34 |
|---|---|---|---|---|
| Core | | | | |
| CD (mm) | 3.9 | 3.9 | 3.9 | 3.9 |
| Diameter (mm) | 37.5 | 37.5 | 37.5 | 37.5 |
| First mid layer | | | | |
| Composition | — | — | — | — |
| Hardness (Shore D) | — | — | — | — |
| Thickness (mm) | — | — | — | — |
| (Second) mid layer | | | | |
| Composition | J3 | J3 | J3 | J3 |
| Hardness (Shore D) | 55 | 55 | 55 | 55 |
| Thickness (mm) | 1.6 | 1.6 | 1.6 | 1.6 |
| Cover | | | | |
| Composition | J2 | J2 | J2 | J2 |
| Hardness (Shore D) | 60 | 60 | 60 | 60 |
| Thickness (mm) | 1.0 | 1.0 | 1.0 | 1.0 |
| THm | 88 | 88 | 88 | 88 |
| THc | 60 | 60 | 60 | 60 |
| THc − THm | −28.0 | −28.0 | −28.0 | −28.0 |
| Dimple | D8 | D9 | D10 | D11 |
| PS (%) | 1.2 | 1.6 | 0.0 | 1.4 |
| PL (%) | 68.4 | 77.2 | 85.3 | 77.1 |
| G | 1.39 | 2.34 | 1.42 | 1.75 |
| Flight distance (m) | 194.6 | 194.0 | 197.2 | 195.2 |
| Spin (rpm) | 2420 | 2420 | 2420 | 2420 |
| Feeling | A | A | A | A |

TABLE II.6

| Results of Evaluation | Sample 35 | Sample 36 | Sample 37 | Sample 38 |
|---|---|---|---|---|
| Core | | | | |
| CD (mm) | 3.9 | 3.9 | 3.9 | 3.9 |
| Diameter (mm) | 37.5 | 37.5 | 37.5 | 37.5 |
| First mid layer | | | | |
| Composition | — | — | — | — |
| Hardness (Shore D) | — | — | — | — |
| Thickness (mm) | — | — | — | — |
| (Second) mid layer | | | | |
| Composition | J3 | J3 | J3 | J3 |
| Hardness (Shore D) | 55 | 55 | 55 | 55 |
| Thickness (mm) | 1.6 | 1.6 | 1.6 | 1.6 |
| Cover | | | | |
| Composition | J2 | J2 | J2 | J2 |
| Hardness (Shore D) | 60 | 60 | 60 | 60 |
| Thickness (mm) | 1.0 | 1.0 | 1.0 | 1.0 |
| THm | 88 | 88 | 88 | 88 |
| THc | 60 | 60 | 60 | 60 |
| THc − THm | −28.0 | −28.0 | −28.0 | −28.0 |
| Dimple | D12 | D13 | D14 | D15 |
| PS (%) | 1.6 | 0.0 | 2.2 | 0.0 |
| PL (%) | 83.0 | 79.7 | 81.0 | 80.5 |
| G | 1.82 | 1.83 | 1.04 | 0.95 |
| Flight distance (m) | 194.8 | 194.4 | 197.0 | 196.0 |
| Spin (rpm) | 2420 | 2420 | 2420 | 2420 |
| Feeling | A | A | A | A |

As shown in Tables II.2 to II.6, each of the golf balls according to Samples 16 to 29 is excellent in flight performance and feel at impact. From the results of evaluation, advantages of the present invention are clear.

[Experiment III]

[Sample 39]

A rubber composition was obtained by kneading 100 parts by weight of a high-cis polybutadiene (trade name "BR-730" manufactured by JSR Corporation), 35 parts by weight of zinc diacrylate, 10 parts by weight of zinc stearate, 5 parts by weight of zinc oxide, an adequate amount of barium sulfate, 0.2 parts by weight of 2-thionaphthol, and 0.75 parts by weight of dicumyl peroxide. This rubber composition was placed into a mold including upper and lower mold halves each having a hemispherical cavity, and heated at 170° C. for 18 minutes to obtain a core with a diameter of 39.1 mm. An amount of compressive deformation CD of the core which was measured under the conditions of: an initial load of 98 N; and a final load of 1274 N, was 2.8 mm.

A resin composition J6 was obtained by kneading 35 parts by weight of nylon 6, 32.5 parts by weight of an ionomer resin (the aforementioned trade name "Surlyn 8150"), 32.5 parts by weight of another ionomer resin (the aforementioned trade name "Surlyn 9150"), 3 parts by weight of titanium dioxide and 0.2 parts by weight of a light stabilizer (trade name "TINUVIN 770") with a twin-screw kneading extruder. The core was covered with the resin composition J6 by injection molding to form a mid layer with a thickness of 1.0 mm.

A resin composition J8 was obtained by kneading 10 parts by weight of an ionomer resin (the aforementioned trade name "Himilan 1555"), 5 parts by weight of another ionomer resin (the aforementioned trade name "Himilan AM7337"), 55 parts by weight of still another ionomer resin (the aforementioned trade name "Himilan AM7329"), 30 parts by weight of an ethylene-methacrylic acid copolymer (trade name "NUCREL N1050H" manufactured by Du Pont-MITSUI POLYCHEMICALS Co., Ltd), 3 parts by weight of titanium dioxide and 0.2 parts by weight of a light stabilizer (the aforementioned trade name "TINUVIN 770") with a twin-screw kneading extruder. The sphere consisting of the core and the mid layer was placed into a final mold having a large number of pimples on its cavity face. The mid layer was covered with the resin composition J8 by injection molding to form a cover with a thickness of 0.8 mm. Dimples having a shape that is the inverted shape of the pimples were formed on the cover.

A clear paint including a two-component curing type polyurethane as the base material was applied to this cover to obtain a golf ball of Sample 39 with a diameter of approximately 42.7 mm and a weight of approximately 45.6 g. A dimple type D1 of the golf ball is shown in detail in the above Tables I.1 and I.6.

[Samples 40 to 44 and 53]

Golf balls of Samples 40 to 44 and 53 were obtained in the same manner as Sample 39, except the specifications of the core, the mid layer and the cover were as shown in Tables III.2 and III.3 below. The compositions of the mid layer and the cover are shown in detail in Table III.1 below. The composition of the core is the same as the composition of the core of Sample 39.

[Samples 47 to 52 and 54 to 61]

Golf balls of Samples 47 to 52 and 54 to 61 were obtained in the same manner as Sample 39, except the specifications of the dimples were as shown in Tables III.3 to III.6 below. The specifications of the dimples are shown in detail in the above Tables I.1 to I.8. The dimple pattern of the golf ball according to Sample 54 is the same as that of the golf ball according to Comparative Example 2 of JP2005-137692. The dimple pattern of the golf ball according to Sample 55 is the same as that of the golf ball according to Comparative Example 4 of JP2006-20820. The dimple pattern of the golf ball according to Sample 56 is the same as that of the golf ball according to Example 1 of JP2013-153966. The dimple pattern of the golf ball according to Sample 57 is the same as that of the golf ball according to Example 4 of JP2005-137692. The dimple pattern of the golf ball according to Sample 58 is the same as that of the golf ball according to Example 2 of JP2005-137692. The dimple pattern of the golf ball according to Sample 59 is the same as that of the golf ball according to Comparative Example 3 of JP2005-137692.

[Sample 45]

A rubber composition was obtained by kneading 100 parts by weight of a high-cis polybutadiene (trade name "BR-730" manufactured by JSR Corporation), 35 parts by weight of zinc diacrylate, 10 parts by weight of zinc stearate, 5 parts by weight of zinc oxide, an adequate amount of barium sulfate, 0.2 parts by weight of 2-thionaphthol, and 0.75 parts by weight of dicumyl peroxide. This rubber composition was placed into a mold including upper and lower mold halves each having a hemispherical cavity, and heated at 170° C. for 18 minutes to obtain a core with a diameter of 38.1 mm. An amount of compressive deformation CD of the core was 2.8 mm.

A resin composition J6 was obtained by kneading 35 parts by weight of nylon 6, 32.5 parts by weight of an ionomer resin (the aforementioned trade name "Surlyn 8150"), 32.5 parts by weight of another ionomer resin (the aforementioned trade name "Surlyn 9150"), 3 parts by weight of titanium dioxide and 0.2 parts by weight of a light stabilizer (trade name "TINUVIN 770") with a twin-screw kneading extruder. The core was covered with the resin composition J6 by injection molding to form a first mid layer with a thickness of 1.0 mm.

A resin composition J9 was obtained by kneading 43 parts by weight of an ionomer resin (the aforementioned trade name "Himilan AM7337"), 40 parts by weight of another ionomer resin (the aforementioned trade name "Himilan AM7329"), 17 parts by weight of a styrene block-containing thermoplastic elastomer (the aforementioned trade name "Rabalon T3221C"), and 6 parts by weight of titanium dioxide with a twin-screw kneading extruder. The first mid layer was covered with the resin composition J9 by injection molding to form a second mid layer with a thickness of 0.80 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the mid layer with a spray gun, and kept at 23° C. for 12 hours to obtain a reinforcing layer with a thickness of 10 μm.

A resin composition J10 was obtained by kneading 100 parts by weight of a thermoplastic polyurethane elastomer (the aforementioned trade name "Elastollan NY90A"), 3 parts by weight of titanium dioxide and 0.2 parts by weight of a light stabilizer (trade name "TINUVIN 770") with a twin-screw kneading extruder. Half shells were formed from this resin composition by compression molding. The sphere consisting of the core, the first mid layer, the second mid layer and the reinforcing layer was covered with two of these half shells. The sphere and the half shells were placed into a final mold that includes upper and lower mold halves each having a hemispherical cavity and having a large number of pimples on its cavity face, and a cover was obtained by compression molding. The thickness of the cover was 0.5 mm. Dimples having a shape that is the inverted shape of the pimples were formed on the cover.

A clear paint including a two-component curing type polyurethane as a base material was applied to this cover to obtain a golf ball of Sample 45 with a diameter of approximately 42.7 mm and a weight of approximately 45.6 g. A dimple type D1 of the golf ball is shown in detail in the above Tables I.1 and I.6.

[Sample 46]

A golf ball of Sample 46 was obtained in the same manner as Sample 45, except the specifications of the core, the first mid layer, the second mid layer and the cover were as shown in Table III.3 below. The compositions of the first mid layer, the second mid layer and the cover are shown in detail in Table III.1 below. The composition of the core is the same as the composition of the core of Sample 45.

[Flight Test]

A #5-iron (trade name "SRIXON 2725" manufactured by DUNLOP SPORTS CO. LTD., shaft hardness: S, loft angle: 25°) was attached to a swing machine manufactured by True Temper Co. A golf ball was hit under the condition of a head speed of 41 m/sec, and the flight distance and the spin rate were measured. The flight distance is a distance from the hitting point to the point at which the ball stopped. The average value of data obtained by 10 measurements is shown in Tables III.2 to III.6 below.

[Feel at Impact]

Ten golf players hit golf balls with #5-irons, and were asked about feeling. The evaluation was categorized as follows based on the number of golf players who answered "the feeling was favorable".

A: 8 to 10

B: 5 to 7

C: 2 to 4

D: 0 to 1

The results are shown in Tables III.2 to III.6 below.

TABLE III.1

Compositions of Mid layer and Cover (parts by weight)

| | J6 | J7 | J8 | J9 | J10 |
|---|---|---|---|---|---|
| polyamide 6 | 35 | — | — | — | — |
| Surlyn 8150 | 32.5 | 50 | — | — | — |
| Surlyn 9150 | 32.5 | 25 | — | — | — |
| Himilan 1555 | — | — | 10 | — | — |
| Himilan 1605 | — | — | | — | — |
| Himilan AM7337 | — | — | 5 | 43 | — |
| Himilan AM7329 | — | 25 | 55 | 40 | — |
| NUCREL N1050H | — | — | 30 | — | — |
| Rabalon T3221C | — | — | — | 17 | — |
| Elastollan NY90A | — | — | — | — | 100 |
| Titanium dioxide (A220) | 3 | 3 | 3 | 6 | 3 |
| TINUVIN 770 | 0.2 | 0.2 | 0.2 | — | 0.2 |
| Slab hardness (Shore D) | 72 | 69 | 61 | 55 | 38 |

TABLE III.2

Results of Evaluation

| | Sample 40 | Sample 41 | Sample 42 | Sample 43 | Sample 44 |
|---|---|---|---|---|---|
| Core | | | | | |
| CD (mm) | 2.8 | 2.8 | 2.8 | 2.8 | 2.8 |
| Diameter (mm) | 37.4 | 37.4 | 38.2 | 38.2 | 39.1 |
| (First) mid layer | | | | | |
| Composition | J1 | J1 | J1 | J1 | J1 |
| Hardness (Shore D) | 72 | 72 | 72 | 72 | 72 |
| Thickness (mm) | 1.0 | 1.0 | 1.0 | 1.0 | 1.0 |
| Second mid layer | | | | | |
| Composition | — | — | — | — | — |
| Hardness (Shore D) | — | — | — | — | — |
| Thickness (mm) | — | — | — | — | — |
| Cover | | | | | |
| Composition | J2 | J3 | J2 | J3 | J2 |
| Hardness (Shore D) | 69 | 61 | 69 | 61 | 69 |
| Thickness (mm) | 1.65 | 1.65 | 1.25 | 1.25 | 0.8 |
| THm | 72.0 | 72.0 | 72.0 | 72.0 | 72.0 |
| THc | 113.9 | 100.7 | 86.3 | 76.3 | 55.2 |
| THc − THm | 41.9 | 28.7 | 14.3 | 4.3 | −16.8 |
| Dimple | D1 | D1 | D1 | D1 | D1 |
| PS (%) | 1.5 | 1.5 | 1.5 | 1.5 | 1.5 |
| PL (%) | 82.4 | 82.4 | 82.4 | 82.4 | 82.4 |
| G | 1.07 | 1.07 | 1.07 | 1.07 | 1.07 |
| Flight distance (m) | 187.0 | 186.8 | 186.6 | 186.4 | 186.3 |
| Spin (rpm) | 4880 | 4910 | 4930 | 4960 | 4970 |
| Feeling | D | C | B | A | A |

TABLE III.3

Results of Evaluation

| | Sample 39 | Sample 45 | Sample 46 | Sample 53 | Sample 47 |
|---|---|---|---|---|---|
| Core | | | | | |
| CD (mm) | 2.8 | 2.8 | 2.8 | 2.8 | 2.8 |
| Diameter (mm) | 39.1 | 38.1 | 38.5 | 40.1 | 39.1 |
| (First) mid layer | | | | | |
| Composition | J1 | J1 | J1 | J1 | J1 |
| Hardness (Shore D) | 72 | 72 | 72 | 72 | 72 |
| Thickness (mm) | 1.0 | 1.0 | 1.0 | 1.0 | 1.0 |
| Second mid layer | | | | | |
| Composition | — | J4 | J4 | — | — |
| Hardness (Shore D) | — | 55 | 55 | — | — |
| Thickness (mm) | — | 0.8 | 0.8 | — | — |
| Cover | | | | | |
| Composition | J3 | J5 | J5 | J5 | J3 |
| Hardness (Shore D) | 61 | 38 | 38 | 38 | 61 |
| Thickness (mm) | 0.8 | 0.5 | 0.3 | 0.3 | 0.8 |
| THm | 72.0 | 58.0 | 58.0 | 72.0 | 72.0 |
| THc | 48.8 | 19.0 | 11.4 | 11.4 | 48.8 |
| THc − THm | −23.2 | −39.0 | −46.6 | −60.6 | −23.2 |
| Dimple | D1 | D1 | D1 | D1 | D2 |
| PS (%) | 1.5 | 1.5 | 1.5 | 1.5 | 1.5 |
| PL (%) | 82.4 | 82.4 | 82.4 | 82.4 | 80.8 |
| G | 1.07 | 1.07 | 1.07 | 1.07 | 0.80 |
| Flight distance (m) | 186.2 | 186.1 | 185.9 | 185.2 | 186.3 |
| Spin (rpm) | 5000 | 5020 | 5050 | 5100 | 5000 |
| Feeling | A | A | A | A | A |

TABLE III.4

Results of Evaluation

| | Sample 48 | Sample 49 | Sample 50 | Sample 51 | Sample 52 |
|---|---|---|---|---|---|
| Core | | | | | |
| CD (mm) | 2.8 | 2.8 | 2.8 | 2.8 | 2.8 |
| Diameter (mm) | 39.1 | 39.1 | 39.1 | 39.1 | 39.1 |
| (First) mid layer | | | | | |
| Composition | J1 | J1 | J1 | J1 | J1 |
| Hardness (Shore D) | 72 | 72 | 72 | 72 | 72 |
| Thickness (mm) | 1.0 | 1.0 | 1.0 | 1.0 | 1.0 |
| Second mid layer | | | | | |
| Composition | — | — | — | — | — |
| Hardness (Shore D) | — | — | — | — | — |
| Thickness (mm) | — | — | — | — | — |
| Cover | | | | | |
| Composition | J3 | J3 | J3 | J3 | J3 |
| Hardness (Shore D) | 61 | 61 | 61 | 61 | 61 |
| Thickness (mm) | 0.8 | 0.8 | 0.8 | 0.8 | 0.8 |
| THm | 72.0 | 72.0 | 72.0 | 72.0 | 72.0 |
| THc | 48.8 | 48.8 | 48.8 | 48.8 | 48.8 |
| THc − THm | −23.2 | −23.2 | −23.2 | −23.2 | −23.2 |
| Dimple | D3 | D4 | D5 | D6 | D7 |
| PS (%) | 1.5 | 1.5 | 1.0 | 1.8 | 0.7 |
| PL (%) | 80.5 | 80.6 | 81.6 | 81.9 | 80.8 |
| G | 0.95 | 0.95 | 0.91 | 1.06 | 0.80 |
| Flight distance (m) | 186.7 | 186.0 | 185.9 | 186.1 | 186.0 |
| Spin (rpm) | 5000 | 5000 | 5000 | 5000 | 5000 |
| Feeling | A | A | A | A | A |

TABLE III.5

| Results of Evaluation | Sample 54 | Sample 55 | Sample 56 | Sample 57 |
|---|---|---|---|---|
| Core | | | | |
| CD (mm) | 2.8 | 2.8 | 2.8 | 2.8 |
| Diameter (mm) | 39.1 | 39.1 | 39.1 | 39.1 |
| (First) mid layer | | | | |
| Composition | J1 | J1 | J1 | J1 |
| Hardness (Shore D) | 72 | 72 | 72 | 72 |
| Thickness (mm) | 1.0 | 1.0 | 1.0 | 1.0 |
| Second mid layer | | | | |
| Composition | — | — | — | — |
| Hardness (Shore D) | — | — | — | — |
| Thickness (mm) | — | — | — | — |
| Cover | | | | |
| Composition | J3 | J3 | J3 | J3 |
| Hardness (Shore D) | 61 | 61 | 61 | 61 |
| Thickness (mm) | 0.8 | 0.8 | 0.8 | 0.8 |
| THm | 72.0 | 72.0 | 72.0 | 72.0 |
| THc | 48.8 | 48.8 | 48.8 | 48.8 |
| THc − THm | −23.2 | −23.2 | −23.2 | −23.2 |
| Dimple | D8 | D9 | D10 | D11 |
| PS (%) | 1.2 | 1.6 | 0.0 | 1.4 |
| PL (%) | 68.4 | 77.2 | 85.3 | 77.1 |
| G | 1.39 | 2.34 | 1.42 | 1.75 |
| Flight distance (m) | 184.4 | 184.1 | 185.7 | 184.7 |
| Spin (rpm) | 5000 | 5000 | 5000 | 5000 |
| Feeling | A | A | A | A |

TABLE III.6

| Results of Evaluation | Sample 58 | Sample 59 | Sample 60 | Sample 61 |
|---|---|---|---|---|
| Core | | | | |
| CD (mm) | 2.8 | 2.8 | 2.8 | 2.8 |
| Diameter (mm) | 39.1 | 39.1 | 39.1 | 39.1 |
| (First) mid layer | | | | |
| Composition | J1 | J1 | J1 | J1 |
| Hardness (Shore D) | 72 | 72 | 72 | 72 |
| Thickness (mm) | 1.0 | 1.0 | 1.0 | 1.0 |
| Second mid layer | | | | |
| Composition | — | — | — | — |
| Hardness (Shore D) | — | — | — | — |
| Thickness (mm) | — | — | — | — |
| Cover | | | | |
| Composition | J3 | J3 | J3 | J3 |
| Hardness (Shore D) | 61 | 61 | 61 | 61 |
| Thickness (mm) | 0.8 | 0.8 | 0.8 | 0.8 |
| THm | 72.0 | 72.0 | 72.0 | 72.0 |
| THc | 48.8 | 48.8 | 48.8 | 48.8 |
| THc − THm | −23.2 | −23.2 | −23.2 | −23.2 |
| Dimple | D12 | D13 | D14 | D15 |
| PS (%) | 1.6 | 0.0 | 2.2 | 0.0 |
| PL (%) | 83.0 | 79.7 | 81.0 | 80.5 |
| G | 1.82 | 1.83 | 1.04 | 0.95 |
| Flight distance (m) | 184.5 | 184.3 | 185.6 | 185.1 |
| Spin (rpm) | 5000 | 5000 | 5000 | 5000 |
| Feeling | A | A | A | A |

As shown in Tables III.2 to III.6, each of the golf balls according to Samples 39 to 52 is excellent in flight performance and feel at impact. From the results of evaluation, advantages of the present invention are clear.

The aforementioned dimples are applicable to golf balls having various structures such as a one-piece golf ball, a two-piece golf ball, a three-piece golf ball, a four-piece golf ball, a five-piece golf ball, a six-piece golf ball, a thread-wound golf ball, and the like. The above descriptions are merely illustrative examples, and various modifications can be made without departing from the principles of the present invention.

What is claimed is:

1. A golf ball having a large number of dimples on a surface thereof, wherein the dimples include a plurality of small dimples each having an area of less than 8.0 $mm^2$, and a plurality of large dimples each having an area of equal to or greater than 8.0 $mm^2$, a ratio PS of a sum of areas of all the small dimples to a surface area of a phantom sphere of the golf ball is less than 2.0%, a ratio PL of a sum of areas of all the large dimples to the surface area of the phantom sphere of the golf ball is equal to or greater than 79.0%, and a degree G of uniformity of areas ($mm^2$) of the large dimples is equal to or less than 1.15.

2. The golf ball according to claim 1, wherein the ratio PS is equal to or greater than 0.7%.

3. The golf ball according to claim 1, wherein the number NS of the small dimples is equal to or greater than 6 but equal to or less than 20.

4. The golf ball according to claim 1, wherein a ratio (NS/N) of the number NS of the small dimples to a total number N of the dimples is equal to or greater than 0.01 but equal to or less than 0.07.

5. The golf ball according to claim 1, wherein each dimple has a depth of a deepest portion from a surface of the phantom sphere of equal to or greater than 0.10 mm but equal to or less than 0.65 mm.

6. The golf ball according to claim 1, wherein a total volume of the dimples is equal to or greater than 450 $mm^3$ but equal to or less than 750 $mm^3$.

7. The golf ball according to claim 1, wherein the ratio PL is equal to or greater than 79.5%, and the degree G of uniformity is equal to or less than 1.10.

8. The golf ball according to claim 7, wherein the ratio PL is equal to or greater than 80.0%, and the degree G of uniformity is equal to or less than 1.05.

9. The golf ball according to claim 1 comprising a core, one or more mid layers positioned outside the core, and a cover positioned outside the mid layers, wherein the cover has a Shore D hardness greater than a Shore D hardness of each of the mid layers, and an average THm of products obtained by multiplying a thickness (mm) by a hardness (Shore D) for each of the mid layers, and a product THc obtained by multiplying a thickness (mm) by a hardness (Shore D) for the cover satisfy the following mathematical formula:

$$THc-THm \leq 50.$$

10. The golf ball according to claim 9, wherein the product THm and the product THc satisfy the following mathematical formula:

$$-50 \leq THc-THm.$$

11. The golf ball according to claim 1 comprising a core, one or more mid layers positioned outside the core, and a cover positioned outside the mid layers, wherein the cover has a Shore D hardness smaller than a Shore D hardness of each of the mid layers, and an average THm of products obtained by multiplying a thickness (mm) by a hardness (Shore D) for each of the mid layers, and a product THc obtained by multiplying a thickness (mm) by a hardness (Shore D) for the cover satisfy the following mathematical formula:

$$-60 \leq THc - THm.$$

12. The golf ball according to claim 11, wherein the product THm and the product THc satisfy the following mathematical formula:

$$THc - THm \leq 40.$$

* * * * *